US007907874B2

(12) United States Patent
Okoshi

(10) Patent No.: US 7,907,874 B2
(45) Date of Patent: Mar. 15, 2011

(54) DEVELOPMENT DEVICE, AND PROCESS CARTRIDGE AND IMAGE FORMING APPARATUS USING THE DEVICE

(75) Inventor: Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 864 days.

(21) Appl. No.: 11/234,303

(22) Filed: Sep. 26, 2005

(65) Prior Publication Data

US 2006/0216067 A1 Sep. 28, 2006

(30) Foreign Application Priority Data

Mar. 24, 2005 (JP) ..... P2005-087273

(51) Int. Cl.
*G03G 15/08* (2006.01)

(52) U.S. Cl. ..... 399/258; 399/119; 399/260

(58) Field of Classification Search ..... 399/106, 399/119, 222, 252, 254, 255, 256, 258, 259, 399/260, 262, 263
See application file for complete search history.

(56) References Cited

U.S. PATENT DOCUMENTS

| | | | | |
|---|---|---|---|---|
| 4,982,238 | A * | 1/1991 | Davidson | 399/253 |
| 5,172,168 | A * | 12/1992 | Satoh et al. | 399/224 |
| 5,434,656 | A | 7/1995 | Nagaoka et al. | |
| 5,617,192 | A * | 4/1997 | Tonomoto et al. | 399/263 |
| 5,943,537 | A * | 8/1999 | Ahn | 399/254 |
| 6,597,882 | B1 | 7/2003 | Tanaka | |
| 2006/0222412 | A1 | 10/2006 | Ito et al. | |

FOREIGN PATENT DOCUMENTS

| | | | |
|---|---|---|---|
| JP | 59061849 A | * | 4/1984 |
| JP | 59061850 A | * | 4/1984 |
| JP | 04-018578 A | | 1/1992 |
| JP | 08-050405 A | | 2/1996 |
| JP | 08-076596 A | | 3/1996 |
| JP | 10-142916 A | | 5/1998 |
| JP | 10-239970 A | | 9/1998 |
| JP | 11-44997 A | | 2/1999 |
| JP | 2001-305861 A | | 11/2001 |

OTHER PUBLICATIONS

Machine translation of Japanese patent document JP10-239970.*
Japanese Office Action issued on Aug. 17, 2010 in the corresponding Japanese Patent Application No. 2005-087273.

* cited by examiner

*Primary Examiner* — David M Gray
*Assistant Examiner* — Andrew V Do
(74) *Attorney, Agent, or Firm* — Sughrue Mion, PLLC

(57) ABSTRACT

A development device includes: a development unit which includes a developer housing room in which developer composed of toner and carrier is housed, sets a developer agitating and transporting member in the developer housing room, and sets a developer bearing member which can bear and transport the developer agitated and transported by the developer agitating and transporting member; and a toner supply unit which includes a toner supply room in which at least supply toner is housed, sets a toner transporting member in the toner supply room, and communicates the toner supply room with the developer housing room of the development unit through a toner supply port, wherein the toner supply port of the toner supply unit opens so that its lower end is located in the lower position than the surface position of the developer housed in the developer housing room.

19 Claims, 19 Drawing Sheets

DEVELOPMENT DEVICE, AND PROCESS CARTRIDGE AND IMAGE FORMING APPARATUS USING THE DEVICE

BACKGROUND OF THE INVENTION

1. Field of the Invention

The present invention relates to a development device used in an image forming apparatus such as an electrophotographic copying machine or a printer. Particularly, the invention relates to improvements of a development device which includes a development unit that makes an electrostatic latent image on an image bearing member visible and a toner supply unit which can supply at least toner to this development unit, and a process cartridge and an image forming apparatus using this development device.

2. Background Art

Conventionally, for example, an electrophotographic image forming apparatus usually adopts a type in which an electrostatic latent image formed on an image bearing member such as a photoconductor drum is toner-developed (made visible) by a development device, and this toner image is transferred onto a transfer medium such as paper or an intermediate transfer member by a transfer device, while residual toner on the image bearing member is picked up by a cleaning device.

As the development device, as shown in FIGS. 18 and 19, a development device 500 has been already provided, which includes a development unit 510 in which developer composed of toner and carrier is housed and used for development, and additionally includes, in order to prolong lift of this development unit 510, a developer supply unit 520 which supplies the developer for the consumed amount of the developer used in the development unit 510 (refer to JP-A-2001-305861, JP-A-10-239970 and JP-A-11-44997).

In a development device shown in JP-A-2001-305861, of the conventional development devices of this type, the development unit 510, as shown in FIG. 18, includes a development housing 511 opposed to an image bearing member 501 such as a photoconductor drum, a developer housing room 512 in which developer G composed of toner and carrier is housed is provided in this development housing 511, a development roll 513 is arranged at the portion faced to an opening of this development housing 511, and further agitation-transportation augers 514 and 515 by which the developer G is agitated and transported are provided in the developer housing room 512.

On the other hand, the developer supply unit 520 includes a supply container 521 in which developer composed of toner and carrier is housed, communicates this supply container 521 with the development housing 511 through a communication duct 522, and can supply the developer in the supply container 521 by dropping by gravity to the upside of the developer G housed in the developer housing room 512.

In FIG. 18, the developer supply unit 520 includes a pick-up container 530 by which the developer G that has deteriorated in the developer housing room 512 can be picked up, and communicates this pick-up container 530 with the developer housing 511 through a communication duct 531.

In developing devices shown in JP-A-10-239970 and JP-A-11-44997, a developing unit 510 is nearly similar to that described in JP-A-2001-305861. However, a developer supply unit 520, as shown in FIG. 19A, includes a supply housing 541 that uses a part of a development housing 511 of the development unit 510 as a partition wall 550, includes in this supply housing 541 a developer supply room 542 in which supply developer is housed, includes an agitator 543 for agitation and transportation in this developer supply room 542, and further includes a developer supply mechanism and a developer pick-up mechanism on the developer unit 510 side of this developer supply room 542.

Here, in the developer supply mechanism, as shown in FIGS. 19A and 19B, a developer supply path 545 is provided by a path partition wall 544, a supply auger 546 is provided in this developer supply path 545, and a supply port 547 is formed in the partition wall 550. This supply port 547, in order to supply the developer smoothly without receiving pressure of the developer G from the developer housing room 512 side, is provided in the higher position than an axial center of an agitation-transportation auger 515, and preferably in the higher position than the surface position of the developer at the portion where the agitation-transportation auger 515 is provided.

On the other hand, in the developer pick-up mechanism, as shown in FIG. 19C, a developer pick-up path 555 is provided by a path partition wall 554, a pick-up auger 556 is provided in this developer pick-up path 555, and a pick-up port 557 is formed in the partition wall 550. This supply port 557, in order to increase the developer pick-up power from the developer housing room 512, is provided in the lower position than the axial center of the agitation-transportation auger 515.

However, any developing devices (including the developer supply unit) in JP-A-2001-305861, JP-A-10-239970 and JP-A-11-44997 adopt a system in which the supply developer is supplied onto the developer housed in the developer housing room of the development unit.

At this time, since the supply developer has a high concentration, and a filling rate of toner is higher than that of carrier, specific gravity of the supply developer is usually smaller than that of the developer in the developer housing room. Under such the state, when the supply developer is supplied onto the developer in the developer housing room, the supply developer enters a state in which it floats on the existing developer. Even in case that the developer is agitated and transported by the agitation-transportation augers 514 and 515, such a technical problem exists that the supply developer is not mixed sufficiently with the existing developer, or it takes time till the supply developer is mixed.

Regarding this technical problem, particularly, in case that the supply developer is only toner, bad agitation and mixing of the supply developer is easy to appear remarkably, because difference in specific gravity between the supply developer (toner) and the existing developer (toner and carrier) becomes large.

As a measure of this technical problem, a technology has been already proposed (refer to, for example, JP-A-10-142916). In this technology, in a type including a development unit and a developer supply unit (toner supply unit), a sub-room is provided adjacently to a developer housing room of the development unit, an agitation-transportation auger is provided in this sub-room, toner supplied from a toner supply port of the toner supply unit is caused to fall in the sub-room to be previously agitated and mixed by the agitation-transportation auger, and thereafter the toner is supplied to the developer housing room.

However, in this type development device, since the previously mixing mechanism (sub-room+agitation-transportation auger) is added to the development unit side, not only the constitution of the device is complicated but also the size of the device itself becomes large. Therefore, this development device is not preferable. Further, since it takes time for previously mixing, there is a fear that follow-up performance of toner concentration worsens (delay in time).

SUMMARY OF THE INVENTION

The invention has been made in order to solve the above technical problem. On the assumption that a development device includes a toner supply unit which can supply at least toner, an object of the invention is to provide a development device which improves agitating and mixing power of toner with the existing developer in a developer housing room with simple constitution, and a process cartridge and an image forming apparatus using this development device.

Namely, according to a first aspect of the invention, there is provided a development device including: a development unit which includes a developer housing room in which developer composed of toner and carrier is housed, sets a developer agitating and transporting member in the developer housing room, and sets a developer bearing member which can bear and transport the developer agitated and transported by the developer agitating and transporting member; and a toner supply unit which includes a toner supply room in which at least supply toner is housed, sets a toner transporting member in the toner supply room, and communicates the toner supply room with the developer housing room of the development unit through a toner supply port, wherein the toner supply port of the toner supply unit opens so that its lower end is located in the lower position than the surface position of the developer housed in the developer housing room.

According to the development device of the invention, in the aspect in which the development unit and the toner supply unit are provided, the toner supply port of the toner supply unit opens so that its lower end is located in the lower position than the surface position of the developer housed in the developer housing room. Therefore, the supply toner can be supplied to the accumulated developer in the developer housing room from the lateral direction, so that agitation and mixing power of the supply toner with the existing developer can be secured without floating the supply toner T on the surface of the developer.

Further, according to a process cartridge or a image forming apparatus using such the development device, it is possible to construct readily a process cartridge or an image forming apparatus in which agitation and mixing power of the supply toner is good.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1A:
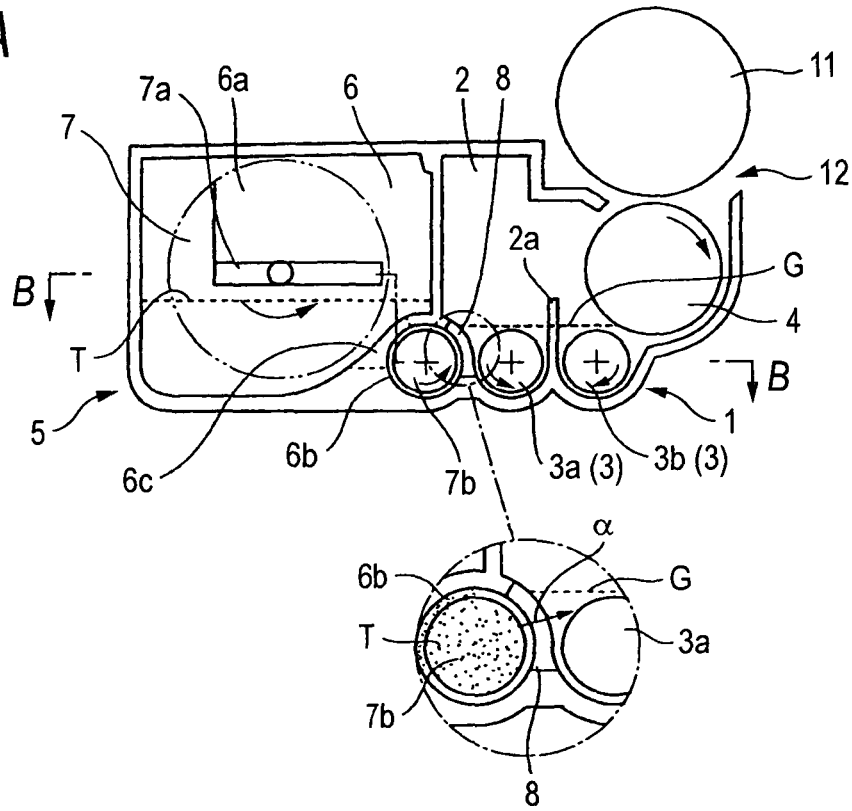
FIG. 1A is an explanatory view showing a development device according to the invention, and a process cartridge and an image forming apparatus using this development device.
Figure 1B:
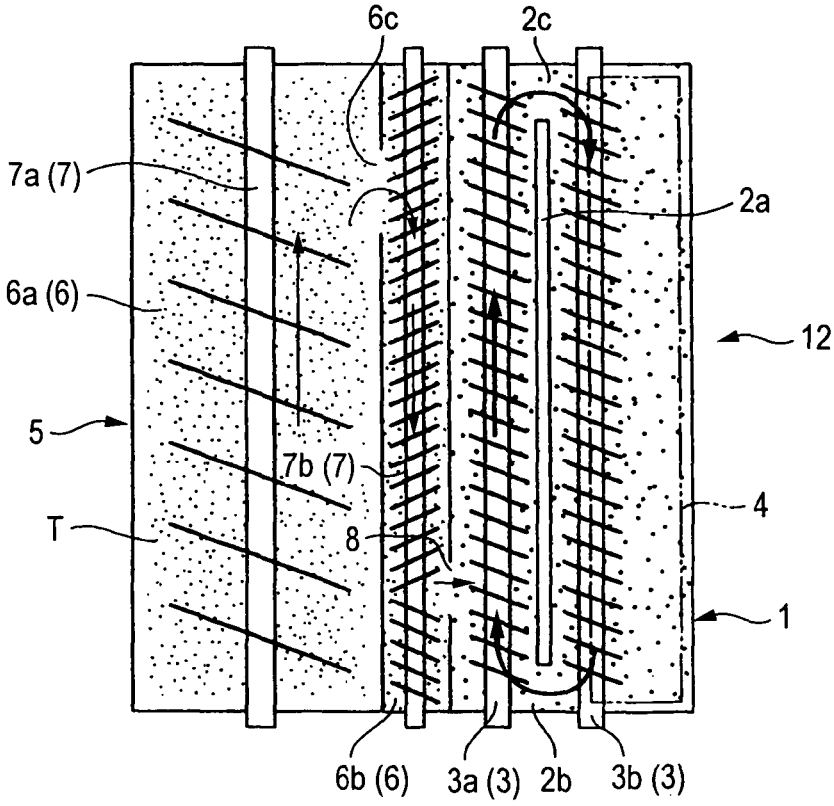
FIG. 1B is a sectional view taken on a line B-B in FIG. 1A.

A development device of the invention, as shown in FIGS. 1A and 1B, includes a development unit 1 which includes a developer housing room 2 in which developer G composed of toner and carrier is housed, sets a developer agitating and transporting member 3 in this developer housing room 2, and sets a developer bearing member 4 which can bear and transport the developer G agitated and transported by this developer agitating and transporting member 3; and a toner supply unit 5 which includes a toner supply room 6 in which at least supply toner T is housed, sets a toner transporting member 7 in this toner supply room 6, and communicates the toner supply room 6 with the developer housing room 2 of the development unit 1 through a toner supply port 8. Herein, the toner supply port 8 of the toner supply unit 5 opens so that its lower end is located in the lower position than the surface position of the developer G housed in the developer housing room 2.

In this technical means, the invention presupposes that the development unit 1 and the toner supply unit 5 are provided.

As long as the development unit 1 includes the developer housing room 2, the developer agitating and transporting member (auger) 3 and the developer bearing member 4, it may include other functional members (a supply member to developer bearing member 4, a layer forming member, and the like) according to necessity.

Here, the developer G housed in the developer housing room 2 is two-component developer that is composed of toner and carrier. Further, as a preferable aspect of this type developer housing room 2, the developer housing room 2 is divided into two sections by a partition wall 2*a* extending in an axial direction of the developer bearing member 4, communication ports 2*b* and 2*c* are provided at both ends in the longitudinal direction of this partition wall 2*a* thereby to form a developer circulating path in the developer housing room 2, and a pair of developer agitating and transporting members 3 (3*a*, 3*b*) are provided in this developer circulating path.

Further, the toner supply unit 5 houses the supply toner T in principle. However, in consideration of a so-called trickle system (system in which developer itself is supplied and the used developer is picked up for discard, supply toner of a high concentration which includes partially carrier is also an object of housing in the toner supply unit.

Further, as long as the toner supply unit 5 includes the toner supply room 6, the toner transporting member 7, and the toner supply port 8, it may be a single unit or may be divided into plural sections.

Here, though the toner supply room 6 may be composed of a room, it preferably had better be composed of plural rooms separated functionally, for example, a toner housing room 6*a* in which the toner is housed and a dispensing room 6*b* which can supply the supply toner quantitatively. Further, as long as the toner transporting member 7 transports at least the toner T to the development unit 2, any member may be widely included in the toner transporting member 7. For example, there are a toner agitating and transporting member 7*a* which agitates and transports the supply toner, and a dispensing auger (dispensing member) 7*b* for supplying the agitated and transported supply toner quantitatively.

Further, the lower end of the toner supply port 8 must be located in the lower position than the surface position of the developer G housed in the developer housing room 2. Namely, at least a part of the toner supply port 8 should be buried under the surface of the developer G in the developer housing room 2, and by supplying the supply toner T to the accumulated developer from a lateral direction as shown by an arrow a, mixing power of the supply toner T with the existing developer G can be secured without floating the supply toner T on the surface of the developer G.

Here, as a preferable condition of toner supply from the toner supply part 8, there is the following: press power by which the supply toner T in the toner supply unit 5 is pushed out from the toner supply port 8 is larger than the internal pressure by the developer G in the developer housing room 2. According to this aspect, even in case that the toner supply port 8 faces in the lower position than the position of the surface of the developer G, the supply toner T can be stably supplied.

Further, as a preferable structure around the toner supply port of the toner supply unit 5, there is the following: the toner transporting member 7 is arranged faced to the toner supply port 8; and the portion facing to the toner supply port 8, of the toner transporting member 7 is formed as a push-out part from which the toner T can be pushed out toward the toner supply port 8.

Therefore, this aspect is preferable because toner supply from the toner supply port 8 is efficiently performed at the push-out part of the toner transporting member 7.

Further, as a representative aspect of the toner supply unit 5, there is a toner supply room including a dispensing mechanism. This dispensing mechanism includes, as the toner supply room 6, in addition to the toner housing room 6*a* in which at least the supply toner T is housed, a dispensing room 6*b* which is formed at the portion faced to the toner supply port 8 and can supply the supply toner quantitatively, and sets a dispensing member 7*b* for quantitative supply in the dispensing room 6*b* as a toner transporting member 7. Further, in FIG. 1B, reference numeral 6*c* represents a dispensing room entrance opening which communicates the toner housing room 6*a* with the dispensing room 6*b*.

The adoption of such the dispensing mechanism is preferable because the toner can be supplied quantitatively.

As preferable aspects of such the dispensing mechanism, there are the following.

It is preferable that the dispensing room entrance opening 6*c* is wider than the toner supply port 8. By providing the wide dispensing room entrance opening 6*c*, the toner internal pressure in the dispensing room 6*b* increases. Therefore, even in case that the toner supply port 8 is located in the lower position than the surface position of the developer G, the supply toner can be stably supplied.

Further, it is preferable that the supply toner transporting length of the dispensing room 6*b* is larger than the dispensing room entrance opening 6*c* length. According to this aspect, the toner internal pressure in the dispensing room 6*b* can be increased uniformly and effectively.

Further, it is preferable that the transporting power of the supply toner T by the dispensing member 7*b* is set larger than the transporting power of the developer G applied to the toner supply port 8 by the developer agitating and transporting member 3 (mainly 3*a*). Herein, the transporting power means transporting power per unit area. By thus setting the transporting power of the supply toner T by the dispensing member 7*b* large, the toner quantitatively supplying operation by the dispensing member 7*b* can be provided surely and stably.

Furthermore, it is preferable that the supply amount of the supply toner to the dispensing room entrance opening 6*c* by the toner transporting member 7 (for example, toner agitating and transporting member 7*a*) of the toner housing room 6*a* is set larger than the transporting amount of the supply toner T by the dispensing member 7*b*. According to this aspect, by setting the supply amount of the supply toner T to the dispensing room entrance opening 6*c* by the toner transporting member 7 larger, the toner internal pressure in the dispensing room 6*b* can be increased uniformly and effectively.

Further, it is preferable that: both of the dispensing member 7*b* and the developer agitating and transporting ember 3 are formed of an auger; and the diameter of the dispensing member 7*b* is set the same as that of the developer agitating and transporting member 3 or less. Thus, by devising the diameter-dimension of the dispensing member (auger) 7*b*, it is possible to secure the transporting power of the supply toner T by the dispensing member 7*b* and to supply the toner effectively from the dispensing room 6*b* to the developer agitating and transporting member.

Further, it is preferable that: both of the dispensing member 7*b* and the developer agitating and transporting member 3 are formed of an auger; and the pitch of the dispensing member 7*b* is set less than that of the developer agitating and transporting member 3. Thus, by devising the pitch dimension of the dispensing member (auger) 7*b*, it is possible to secure the transporting power of the supply toner T by the dispensing member 7*b* and to supply the toner effectively from the dispensing room 6*b* to the developer agitating and transporting member.

Further, in the aspect in which the dispensing mechanism is provided, it is preferable that the portion faced to the toner supply port 8, of the toner dispensing member 7*b* is formed as a push-out part by which the toner can be pushed out toward the toner supply port 8.

Here, as various aspects of the push-out part, there are the following.

As an example, the dispensing member 7*b* is formed of an auger, and a vane member for weir is provided at the portion faced to the toner supply port 8, of this dispensing member 7*b*. According to this aspect, the toner transported by the dispensing member 7*b* is dammed up by the vane member for weir, whereby the toner internal pressure can be increased effectively.

As another example, the dispensing member 7*b* is formed of an auger, and a vane member along the axial direction is provided at the portion faced to the toner supply port 8, of this dispensing member 7*b*. By this vane member along the axial direction, the toner can be actively pushed out toward the toner supply port 8, whereby the toner internal pressure can be increased effectively.

Further, as another example, the dispensing member 7*b* is formed of an auger, and the vane pitch at the portion faced to the toner supply port 8, of this dispensing member 7*b* is set narrow than the vane pitch at other portions. According to this aspect, by narrowing the vane pitch, the toner internal pressure faced to the toner supply port 8 can be increased effectively.

Further, as a preferable aspect of the toner supply port 8, an eaves-shaped return part facing in the toner transporting direction is provided at a toner transporting direction downstream side edge of the portion faced to the toner supply port 8, of the toner supply port 8 edge. By providing such the eaves-shaped return part, it functions as a toner transporting guide to the toner supply port 8, so that the toner is smoothly exhausted.

Further, as a preferable aspect of the toner supply port 8, the lower end of the toner supply port 8 is located in the lower position than a rotation center of the developer agitating and transporting member 3 (mainly 3*a*). In this case, since the toner is supplied from the lower position than the rotation center position of the developer agitating and transporting member 3, the supplied toner is rolled in the developer agitating and transporting member 3, and speedily agitated and mixed. Therefore, this aspect is preferable.

Furthermore, in FIG. 1A, though the upper end of the toner supply port 8 is located in the higher portion than the upper end portion of the developer agitating and transporting member 3 (mainly 3*a*), the invention is not limited to this. Depending on the layout, it is preferable that the upper end of the toner supply port 8 is located in the lower portion. In this case, since the toner is supplied from the lower position than the upper end position of the developer agitating and transporting member 3, the supplied toner is rolled in the developer agitating and transporting member 3, and speedily agitated and mixed. Therefore, this aspect is preferable.

Further, as a preferable aspect of the toner supply room 6 including the dispensing room 6*b*, the capacity of the toner housing room 6*a* other than the dispensing room 6*b*, of the toner supply room 6 is set larger than the capacity of the dispensing room 6*b*. Alternatively, the capacity of the toner housing room 6*a* other than the dispensing room 6*b*, of the toner supply room 6 is set larger than the total capacity of the dispensing room 6*b* and the developer housing room 2. In this case, the toner can be stably supplied to the developer housing room 2. Here, the capacity means the toner housing amount or the developer housing amount.

Further, as a preferable aspect of the toner supply unit including the dispensing mechanism, a toner agitating and transporting member 7*a* as the toner transporting member 7 is provided in the toner housing room 6*a* other than the dispensing room 6*b*, of the toner supply room 6, and a rotation center of this toner agitating and transporting member 7*a* is located in the higher position than the dispensing member 7*b*. According to this aspect, it is not necessary to lift the toner from the toner housing room 6*a* to the dispensing room 6*b*. Therefore, the toner internal pressure in the dispensing room 6*b* can be effectively increased.

Further, as another aspect, a toner agitating and transporting member 7*a* as the toner transporting member 7 is provided in the toner housing room 6*a* other than the dispensing room 6*b*, of the toner supply room 6, and a rotation center of this toner agitating and transporting member 7*a* is located in the higher position than the developer agitating and transporting member 3 (mainly 3*a*). According to this aspect, it is not necessary to lift the toner from the toner housing room 6*a* to the developer housing room 2. Therefore, without losing the toner internal pressure in the dispensing room 6*b*, the toner can be smoothly supplied to the developer housing room 2.

Furthermore, it is preferable that a center of the dispensing member 7*b* is set at the same height as the height of a rotation center of the developer agitating and transporting member 3 (mainly 3*a*) or in the lower position. In this case, since the toner is supplied from the lower position than the rotation center position of the developer agitating and transporting member 3, the supplied toner is rolled in the developer agitating and transporting member 3, and speedily agitated and mixed. In addition, flattening of the development unit 1 is also possible.

The invention is not limited to the above development device, but can be also applied to the following process cartridge and image forming apparatus.

Namely, a process cartridge according to the invention, as shown in FIG. 1A, is detachably attached to an image forming apparatus body; and includes an image bearing member 11, and the above development device 12 which is arranged opposed to this image bearing member 11 and can make an electrostatic latent image on the image bearing member 11 visible.

Further, as long as an image forming apparatus according to the invention includes an image bearing member 11, and the above development device 12 which is arranged opposed to this image bearing member 11 and can make an electrostatic latent image on the image bearing member 11 visible, the development device 12 may be not only a process cartridge type but also a not-process cartridge type.

With reference to embodiments shown in attached drawings, the invention will be described below in detail.

Embodiment 1

Whole Construction of Image Forming Apparatus

Figure 2:
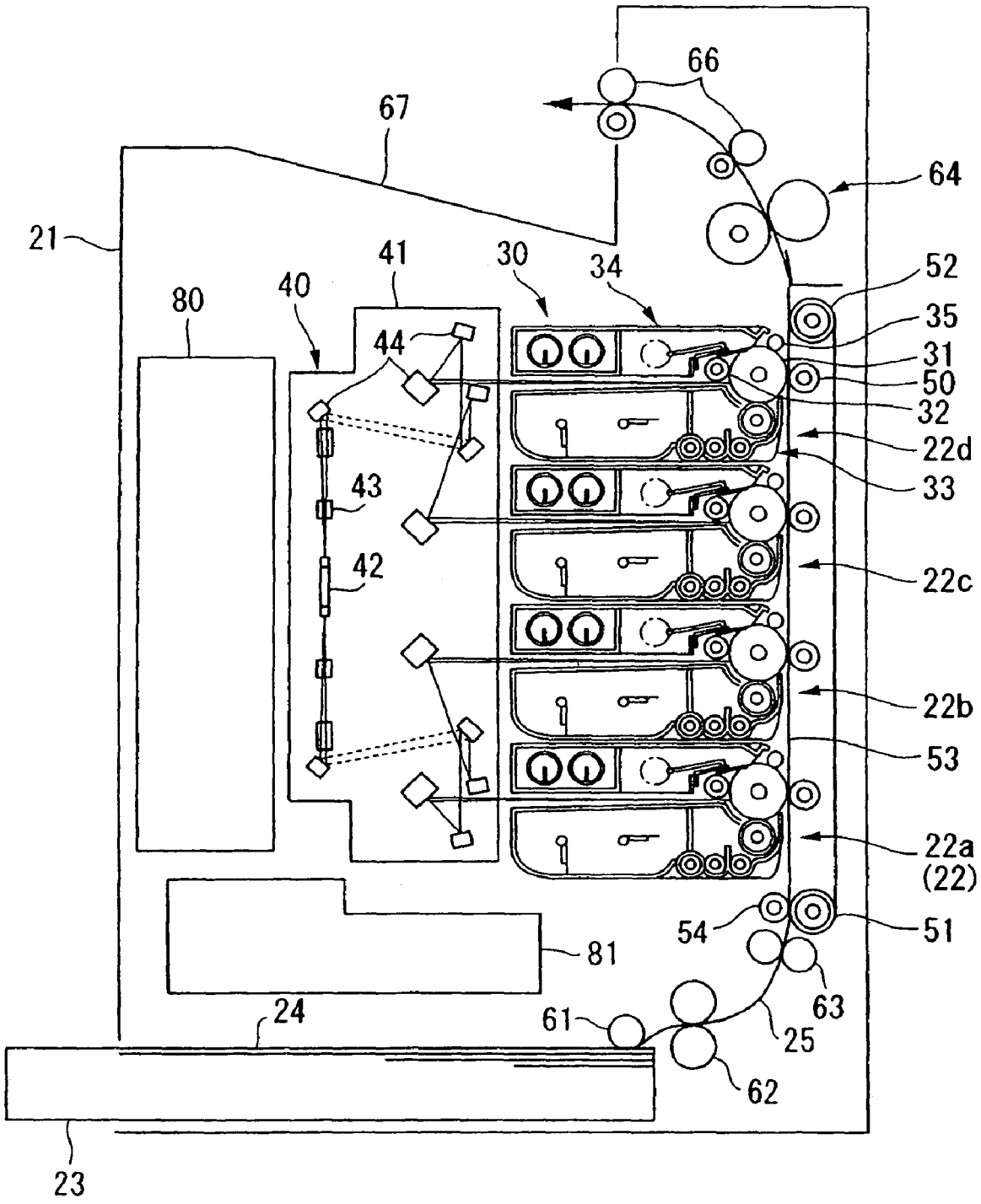
FIG. 2 is an explanatory view showing a first embodiment of the image forming apparatus according to the invention.

FIG. 2 shows a first embodiment of an image forming apparatus to which the invention is applied.

In FIG. 2, the image forming apparatus is a so-called tandem type color image forming apparatus, in which image forming units 22 (specifically 22*a* to 22*d*) of four colors (yellow, magenta, cyan, and black in this embodiment) are arranged lengthways in an apparatus housing 21, a paper supply cassette 23 in which paper 24 for supply is housed is provided for the lower portion of the apparatus, and a paper transporting path 25 that is a transporting path of the paper 24 from the paper supply cassette 23 is vertically arranged correspondingly to the respective image forming units 22.

In the embodiment, the image forming units 22 (22*a* to 22*d*) form toner images for yellow, magenta, cyan, and black in order from the upstream side of the paper transporting path 25; and each unit includes a process cartridge 30 incorporating various process units, and an exposure device 40 which radiates scanning light for imaging to this process cartridge 30.

Here, in the process cartridge 30, for example, a photoconductor drum 31, a charge roll 32 which previously charges this photoconductor drum 31, a development device 33 which develops an electrostatic latent image exposure-formed on the charged photoconductor drum 31 by the exposure device 40 with the corresponding color toner (for example, negative polarity in the embodiment) a cleaning device 34 which removes water toner on the photoconductor drum 31, and an erasable lamp 35 which erases electricity from the surface of the charged photoconductor drum 31 are integrally formed into a cartridge.

On the other hand, the exposure device 40 houses a not-shown semiconductor laser, a polygon mirror 42, an imaging lens 43, and a mirror 44 in a case 41. The exposure device 40 deflection-scans the light from the semiconductor laser by the polygon mirror 42 thereby to lead a light image to an exposure point on the photo conductor drum 31 through the imaging lens 43 and the mirror 44.

Further, in the embodiment, in the portion corresponding to each photoconductor drum 31 of each image forming unit 22, a transporting belt 53 which circulates along the paper transporting path 25 is provided.

This transporting belt 53 is formed of a belt material (rubber or resin) which can electrostatically absorb the paper 24, and laid between a pair of tension rolls 51 and 52. In the embodiment, the upper tension roll 52 functions as a drive roll, and the lower tension roll 51 functions as a driven roll.

Furthermore, at an entrance portion (portion opposed to the tension roll 51) of the transporting belt 53, a paper absorption roll 54 is provided. By applying absorption voltage that is high voltage to this paper absorption roll 54, the paper 24 is absorbed onto the transporting belt 53. Further, on a back side of the transporting belt 53 corresponding to the photoconductor drum 31 of each image forming unit 22, a transfer roll 50 is provided. This transfer roll 50 brings the paper 24 on the transporting belt 53 closer to the photoconductor drum 31. Between the transfer roll 50 and the photoconductor drum 31, the predetermined transfer bias is appropriately applied by a transfer bias power supply.

Further, in the embodiment, near the paper supply cassette 23, a pick-up roll 61 which feeds out the paper 24 at the predetermined timing is provided, whereby the paper is fed through a feed roll 62 and a registration roll 63 in a transfer position.

Further, on the paper transporting path 25 located on the downstream side of the most downstream image forming unit 22*d*, a fixing device 64 is provided. On the downstream side of this fixing device 64, a discharge roll 66 for discharging paper is provided. By the discharge roll 66, the discharged paper is caught in a catch tray 67 formed at the upper portion of the apparatus housing 21.

In FIG. 2, reference numeral 80 represents a high voltage power supply which supplies high voltage to the device for high voltage, and reference numeral 81 represents a low voltage power supply which supplies low voltage to the device for low voltage.

An image forming process by such the image forming apparatus is as follows.

As shown in FIG. 2, in each image forming unit 22 (22*a* to 22*d*), the photoconductor drum 31 is charged by the charge roll 32, a latent image is formed on the photoconductor drum 31 by the exposure device 40, and thereafter a visible image (toner image) is formed by the development device 33.

On the other hand, the paper 24 is fed out from the paper supply cassette 23 by the pick-up roll 61 at the predetermined timing, fed through the feed roll 62 and the registration roll 63 in the absorption position of the transporting belt 53, and fed in the transfer position in a state where the paper 24 is absorbed onto the transporting belt 53.

The toner image on the photoconductor drum 31 in each image forming unit 22 is transferred onto the paper 24 by the transfer roll 50, and the non-fixed toner image of each color component on the paper 24 is fixed by the fixing device 64. Thereafter, the paper 24 on which the toner image has been fixed is discharged into the catch tray 67.

Summary of Process Cartridge

Figure 3:
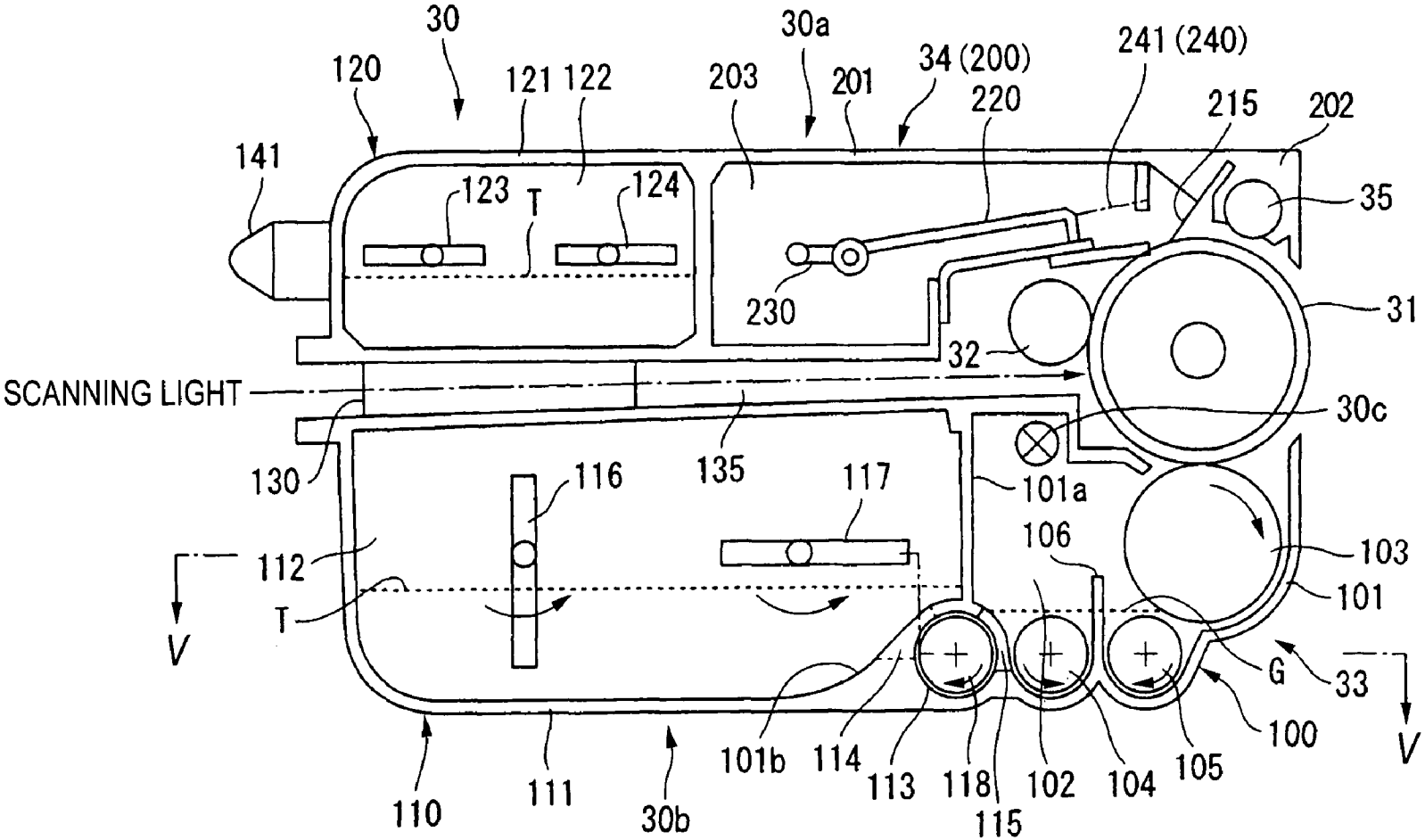
FIG. 3 is an explanatory view showing the details of the process cartridge used in this embodiment.

FIG. 3 shows the details of the process cartridge 30 used in the embodiment.

In FIG. 3, the process cartridge 30 includes, in addition to the photoconductor drum 31, the charge roll 32, a part of the development device 33, and the cleaning device 34, a photoconductor cartridge 30*a* including the erasable lamp 35 which erases the electricity of the photoconductor drum 31 before the cleaning operation; and a development cartridge 30*b* which is provided under this photoconductor cartridge 30*a* swingably and in a positioned state in relation to the photoconductor cartridge 30*a*, and includes main parts of the development device 33.

Particularly, in the embodiment, the development device 33 includes a development unit 100 which is opposed to the photoconductor drum 31 and makes an electrostatic latent image on the photoconductor drum 31 visible with developer G composed of toner and carrier, and toner supply units 110 and 120 which supply toner T to this development unit 100 (a separation type including a main toner supply unit 110 and a sub-toner supply unit 120 is adopted in the embodiment).

The photoconductor cartridge 30*a* is formed by uniting a cleaning unit 200 in which the cleaning device 34 is unitized and the sub-toner supply unit 120 in the lateral direction. Further, the development cartridge 30*b* is formed by uniting the development unit 100 and the main toner supply unit 110 in the lateral direction.

Further, in the embodiment, the development cartridge 30*b* is provided swingably by a pivot 30*c* of the development unit 100 portion in relation to the photoconductor cartridge 30*a* positioned and fixed to the apparatus housing 21, and a scanning path 135 in which the scanning light from the exposure device 40 can pass is secured between the photoconductor cartridge 30*a* and the development cartridge 30*b*. On both sides of each part-cartridge 30*a*, 30*b* near the entrance of this scanning path 135, spacers 130 made of an elastic member are interposed, and pressurizes and energizes the development cartridge 30*b* against the photoconductor cartridge 30*a*. Further, in place of the spacer 130, or in addition to the spacer 130, an energizing element such as an energizing spring may be used.

Figure 4A:
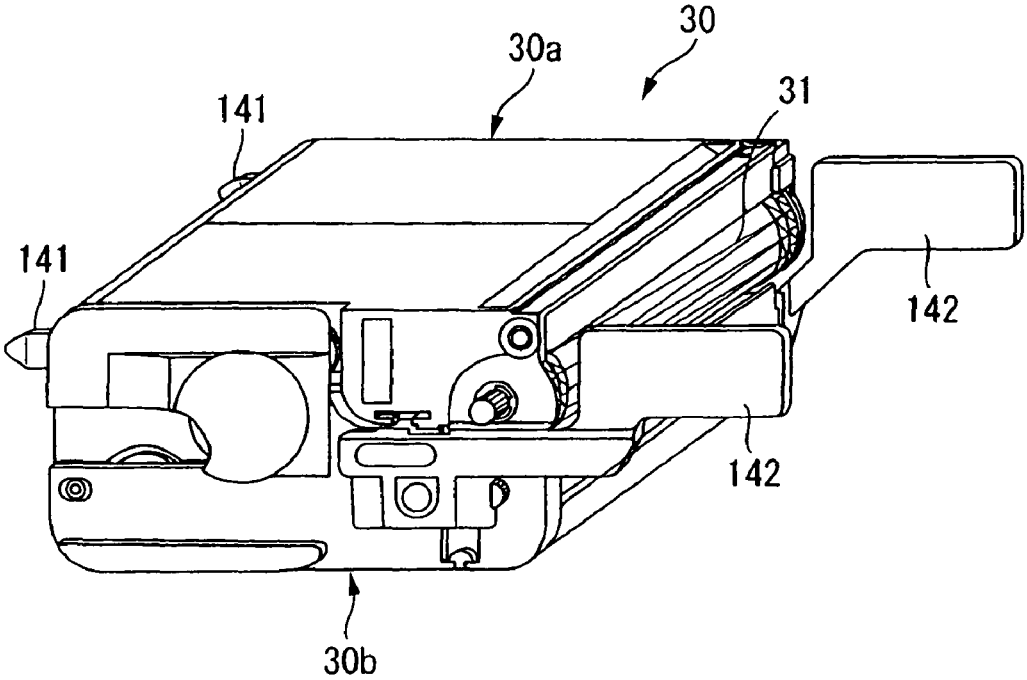
FIG. 4A is a diagram showing the process cartridge used in the embodiment, viewed from one side.
Figure 4B:
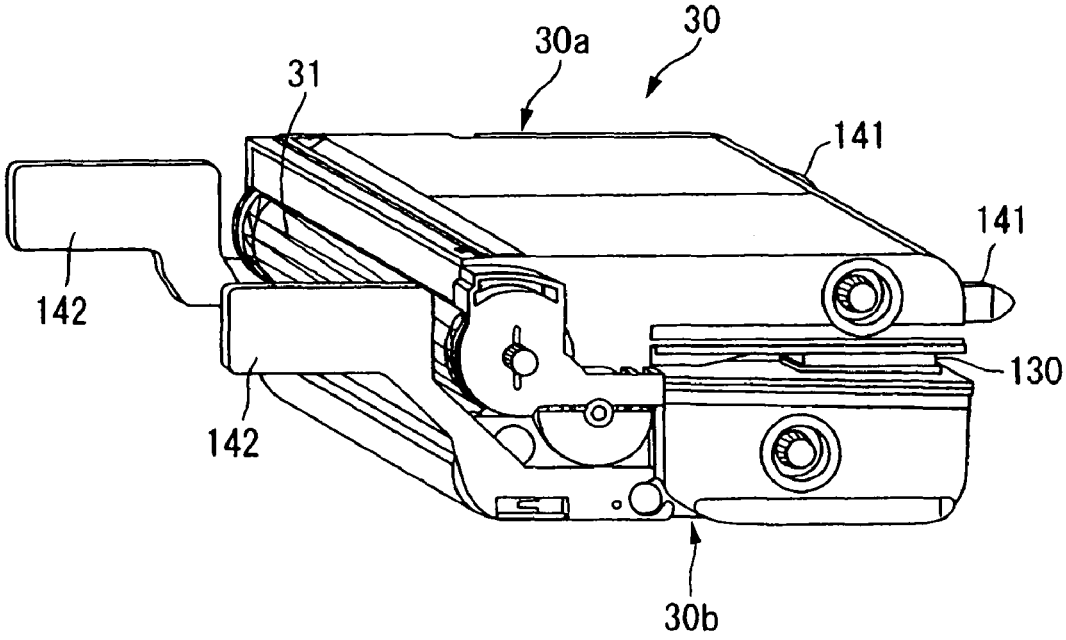
FIG. 4B is a diagram showing the process cartridge used in the embodiment, viewed from the other side opposite to the side in FIG. 4A.

Further, in the embodiment, as shown in FIGS. 3, 4A, and 4B, a pair of support projections 141 extending in the direction orthogonal to the axial direction of the photoconductor drum 31 are provided for the sub-toner supply unit 120 of the photoconductor cartridge 30*a*.

When the process cartridge 30 is attached to a cartridge reception part (not shown) of the apparatus housing 21, both ends of a support shaft of the photoconductor drum 31 are fixed in the predetermined position by a fixing-reception member (not shown) provided for the cartridge reception part, and a drive transmission member (drive transmission gear) provided for one end of the photoconductor drum 31 which is rotatable around the support shaft is coupled and fitted to a drive system (not shown) provided for the cartridge reception part. Further, the support projection pair 141 is fitted to a fitted part (recess part or hole) of the cartridge reception part, whereby the photoconductor cartridge 30*a* is positioned and fixed to the apparatus housing 21. Here, as long as the cartridge reception part of the apparatus housing 21 can receive and hold the process cartridge 30, the housing frame itself may be used as the reception part, or another member may be provided for the housing frame.

Particularly, in the embodiment, since the support projection 141 is provided for a unit outer wall distant from the photoconductor drum 31, and positioned in the direction different from the axial direction of the photoconductor drum 31, it can stably supports the photoconductor cartridge 30*a*. Further, the support projections 141 are provided in pair, weight loads onto the process cartridge 30 at each of four support points of the photoconductor cartridge 30*a* are reduced, and distortion of the process cartridge 30 is also corrected.

In FIG. 4, reference numeral 142 is a hold arm used when the process cartridge 30 is attached or detached.

Development Device

The respective units 100, 110, and 120 constituting the development device 33 used in the embodiment will be described.

Development Unit

Figure 5:
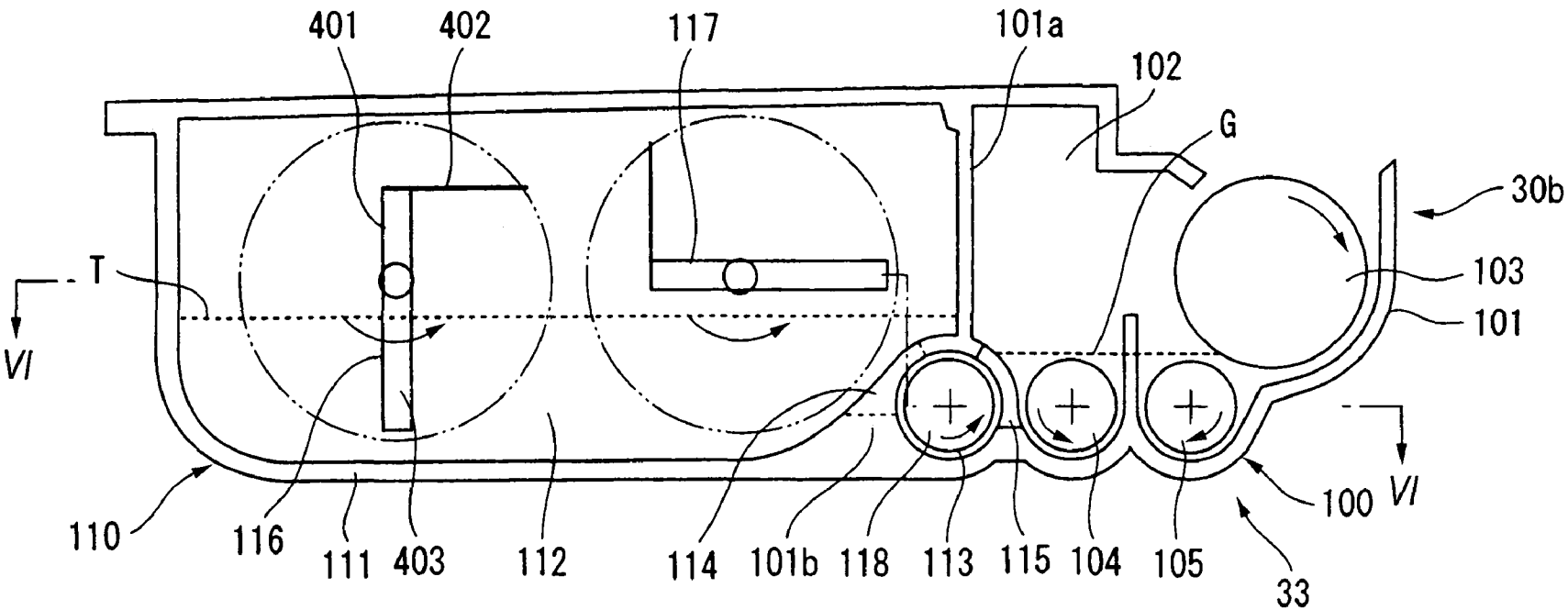
FIG. 5 is an explanatory view showing a development cartridge used in the embodiment.
Figure 6:
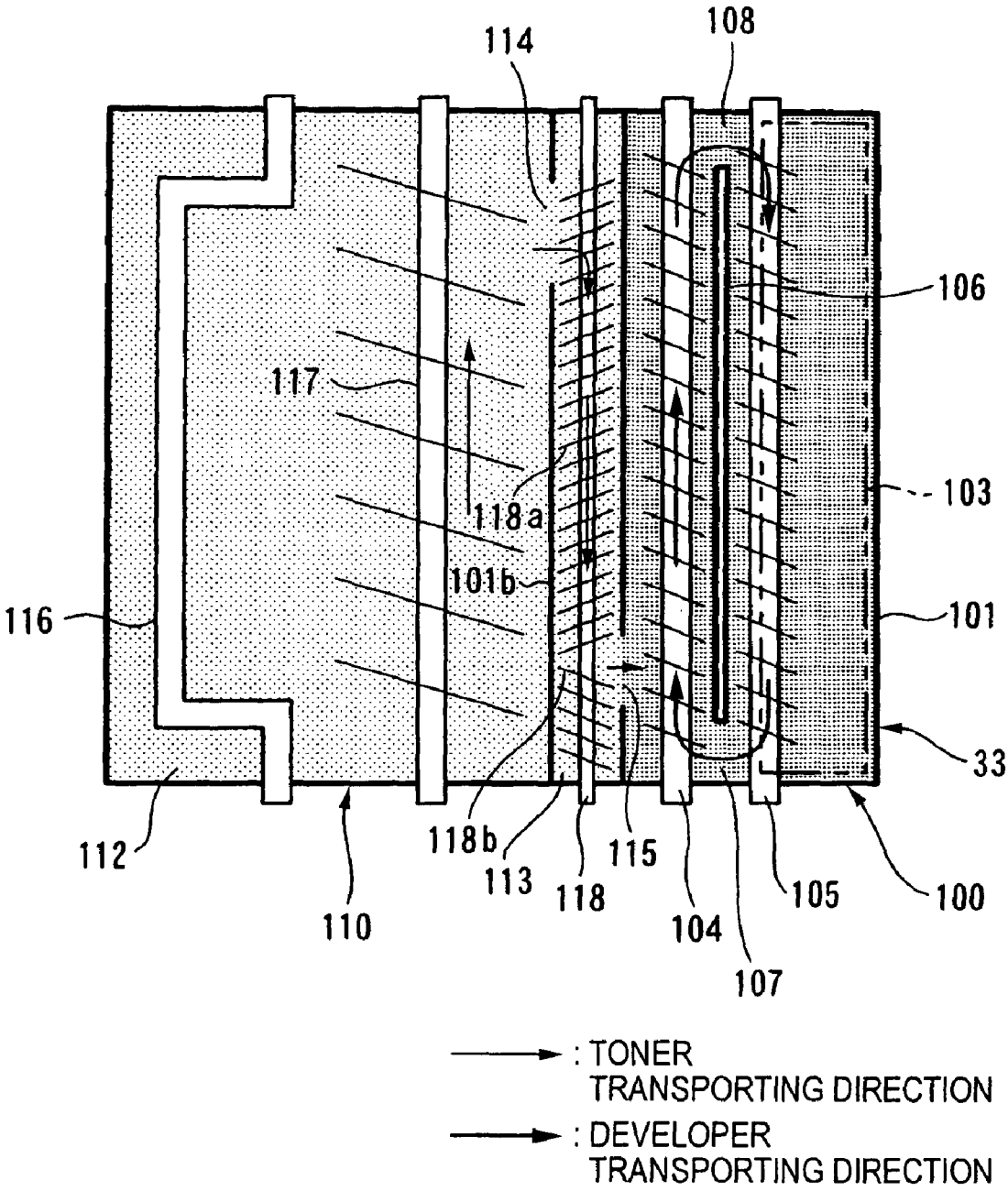
FIG. 6 is an explanatory view partially broken on a line VI-VI in FIG. 5.

In the embodiment, the development unit 100, as shown in FIGS. 3, 5 and 6, adopts a so-called two-component development system. The development unit 100 includes, below the photoconductor drum 31, a development housing 101 which opens toward the photoconductor drum 31 side. The inside of this development housing 101 is constituted as a developer housing room 102 in which developer G composed of toner and carrier can be housed, and a development roll 103 for bearing the developer is provided at the portion faced to the opening of the development housing 101. In this development unit 100, the developer housing room 102 is divided into two rooms by a partition wall 106 extending in the axial direction of the development roll 103, and communication ports 107 and 108 are provided at both ends in the longitudinal direction of this partition wall 106 thereby to form a developer circulating path in the developer housing room 102. In this developer circulating path, a pair of agitating and transporting augers 104 and 105 is provided in the axial direction of the development roll 103, whereby the developer G in the developer circulating path is transported while being agitated.

Here, the agitating and transporting auger 104 is an admixing auger which has the main aim of devotedly agitating and mixing the supplied toner T with the existing developer G, while the agitating and transporting auger 105 is a supply auger which takes, in addition to the toner agitating and mixing function, a function of supplying developer to the developer roll 103.

In the embodiment, though the agitating and transporting auger 105 near the development roll 103 takes the function of supplying developer to the developer roll 103, a developer supply member (roll or paddle) may be added separately from the agitating and transporting auger 105. Further, around the development roll 103, a trimming member for regulating developer layer thickness or a pick-up member for picking up unused developer may be provided according to necessity.

Main Toner Supply Unit

Further, the main toner supply unit 110, as shown in FIGS. 3, 5 and 6, includes a main supply housing 111 which uses partially the backside partition wall of the development housing 101 of the development unit 100. The inside of this main supply housing 111 is used as a toner supply room in which the supply toner T is housed in a suppliable state.

Particularly, in the embodiment, the toner supply room is divided into a toner housing room 112 in which the supply toner T is housed, and a dispensing room 113 which communicates with this toner housing room 12 and supplies the toner T to the development unit 100 quantitatively. Here, the dispensing room 113 has a thick portion 101*b* near the lower portion of a backside partition wall 101*a* of the development housing 101, and is formed as a long path (tunnel-shaped path) which extends in this thick portion 101*b* in the axial direction of the development roll 103.

At the portion faced to the toner housing room 112 on the backside in the longitudinal direction of the thick part 101*b*, a dispensing room entrance opening 114 is provided. Further, at the portion faced to the developer housing room 102 of the thick portion 101*b*, and on the opposite side in the longitudinal direction to the dispensing room entrance opening 114 side, a toner supply port 115 is provided.

Further, in the toner housing room 112, an agitator 116 for agitating and transporting the supply toner T, and an agitator 117 for agitating and transporting the toner T agitated and transported by this agitator 116 toward the dispensing room entrance opening 114 of the dispensing room 113 are provided.

Here, as shown in FIG. 5, the agitator 116 has an agitation film 402 made of a PET film at a leading end of a clunk-shaped rotary rod 401, and this agitation film 402 transports the toner along the wall surface of the toner supply room. On the opposite side to the agitation film 402 side of the rotary rod 401, the appropriate number of agitation rods 403 extending in the diameter direction of the rotary rod 401 are provided in order to agitate the toner in the toner supply room. The agitator 117 may be constituted similarly to the agitator 116. However, it is preferable that the toner transporting direction is adjusted toward the dispensing room entrance opening 114 by, for example, appropriately providing nicks in the agitation film. Further, as the agitators 116 and 117, an agitating and transporting coil spring may be used.

In FIG. 6, the forms of the agitators 116 and 117 are shown schematically.

On the other hand, in the dispensing room 113, a dispensing auger 118 is provided in the longitudinal direction. Particularly, in the embodiment, the dispensing auger 118 includes a spiral vane of the nearly same diameter as the diameter of the spiral vane of the agitating and transporting auger 104, 105 in the development unit 100, or a spiral vane of smaller diameter. Further, the vane pitch of the dispensing auger 118 is set less than the vane pitch of the agitating and transporting auger 104, 105.

Figure 7A:
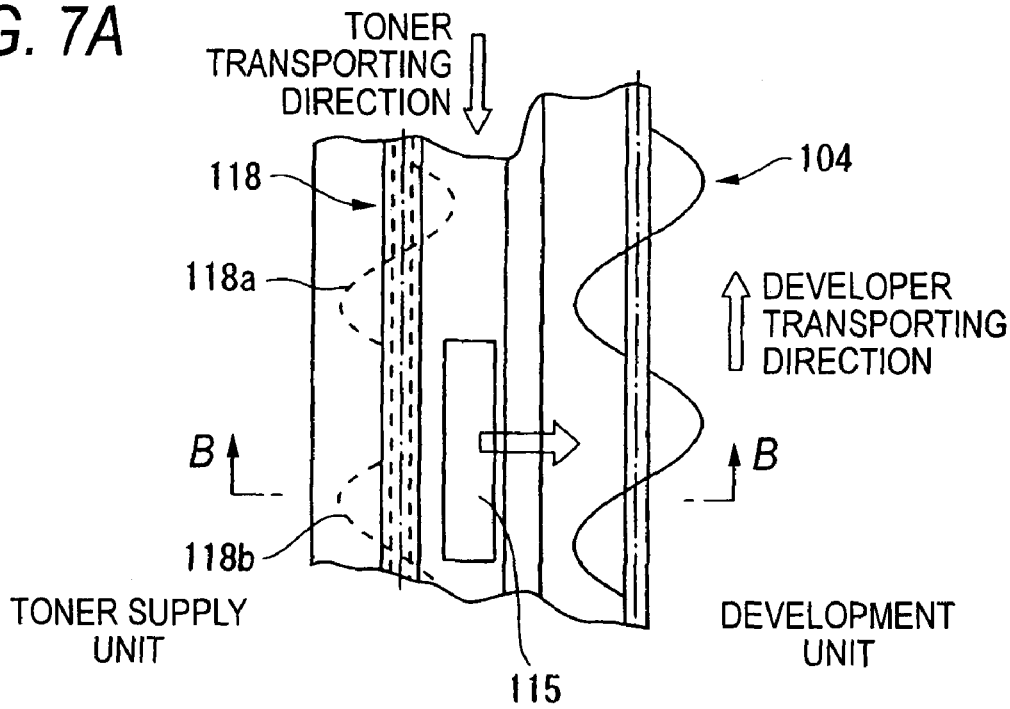
FIG. 7A is an explanatory view showing the structure around a toner supply port in the embodiment.
Figure 7B:
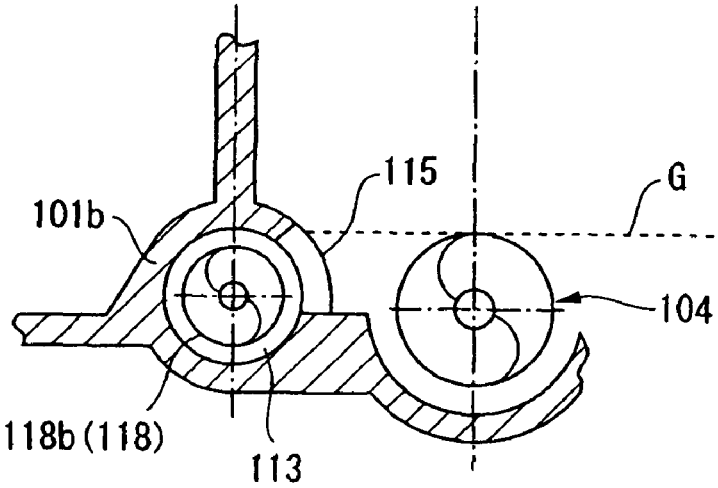
FIG. 7B is a sectional view taken on a line B-B in FIG. 7A.

Further, in the embodiment, the toner supply port 115, as shown in FIGS. 7A and 7B, opens so that its lower end is located in the lower position than the surface position of the developer G housed in the developer housing room 102. Namely, as long as the supply port 115 is at least buried in the surface position of the developer G in the developer housing room 102, the supply toner T can be supplied from the latent side to the accumulated developer in the developer housing room 102, whereby agitating and mixing power of the supply toner T with the developer G is secured.

Particularly, in the embodiment, press power by which the supply toner T in the toner supply unit 110 is pushed out from the toner supply port 115 is set larger than the internal pressure by the developer G in the developer housing room 102.

Specifically, the dispensing room entrance opening 114 is formed wider than the toner supply port 115. Further, the longitudinal length of the dispensing room 113 is set longer than the length of the dispensing room entrance opening 114. Further, the amount of supplying toner to the dispensing room entrance opening 114 by the agitator 117 is set larger than the amount of toner transportation (corresponding to the supply amount of the toner exhausted from the toner supply port 115) by the dispensing auger 118.

Furthermore, the diameter size, the vane pitch, the number of turns of the dispensing auger 118 are selected so that the toner internal pressure based on the toner transporting power by the dispensing auger 118 becomes larger than the internal pressure (depending on the transporting power of the agitating and transporting auger 104) of the developer G in the developer housing room 102, which is applied to the toner supply port 115.

Further, in the embodiment, as shown in FIGS. 7A and 7B, the dispensing auger 118 includes, in addition to the usual agitating and transporting auger vane 118*a*, an auger vane for weir 118*b* at the portion faced to the toner supply port 115. The toner T dammed up by this auger vane 118*b* for weir is pushed out from the toner supply port 115 to the developer housing room 102.

In the embodiment, though the toner supply port 115 opens in the position distant from the end position of the developer housing room 102, the supply toner T is pushed out from the toner supply port 115 by pushing-out action by the auger vane for weir 118*b*.

Further, in the embodiment, the upper end of the toner supply port 115 is located in the higher position than the upper end portion of the admixing auger 104. However, depending on a layout, for example, by setting the upper end of the toner supply port 115 so as to be located in the lower position, the toner is supplied from the lower position than the position of the upper end portion of the admixing auger 104. Correspondingly, the supplied toner is rolled in the admixing auger 104, and speedily agitated and mixed (refer to, for example, Embodiment 5).

Furthermore, since the lower end of the toner supply port 115 is set in the lower position than a rotation center position of the admixing auger 104, the toner T is supplied from the lower position than the rotation center position of the admixing auger 104. Correspondingly, the supplied toner T is rolled in the admixing auger 104, and speedily agitated and mixed.

Further, since a center of the dispensing auger 118 is set at the same height as the rotation center height of the admixing auger 104 or in the lower position, the toner is supplied from the lower position of the rotation center position of the admixing auger 104. Correspondingly, the supplied toner T is rolled in the admixing auger 104, and speedily agitated and mixed.

Further, in case that the capacity of the toner housing room 112 is made larger than the capacity of the dispensing room 113, or the total capacity of the dispensing room 113 and the developer housing room 102, the toner from the toner supply port 115 can be continuously supplied stably. Here, the capacity means the toner housing amount or the developer housing amount.

Further, in the embodiment, the agitators 116 and 117 are arranged so that each rotation center of them is located in the higher position than each position of the dispensing auger 118 and the agitating and transporting augers 104 and 105.

Therefore, it is not necessary to lift the toner from the toner housing room 112 to the dispensing room 113 and the developer housing room 102. Therefore, the toner internal pressure in the dispensing room 113 can be effectively increased. Further, without losing the toner internal pressure in the dispensing room 113, the toner can be smoothly supplied to the developer housing room 2.

Sub Toner Supply Unit

In the embodiment, the sub-toner supply unit 120, as shown in FIG. 3, includes a sub-supply housing 121 adjacent to the backside of the cleaning unit 200, and the inside of this sub-supply housing 121 is used as a toner housing room 122 in which the supply toner T is housed suppliably.

In the toner supply room 122, a pair of agitators 123 and 124 for agitating and transporting the supply toner T is provided.

Figure 8:
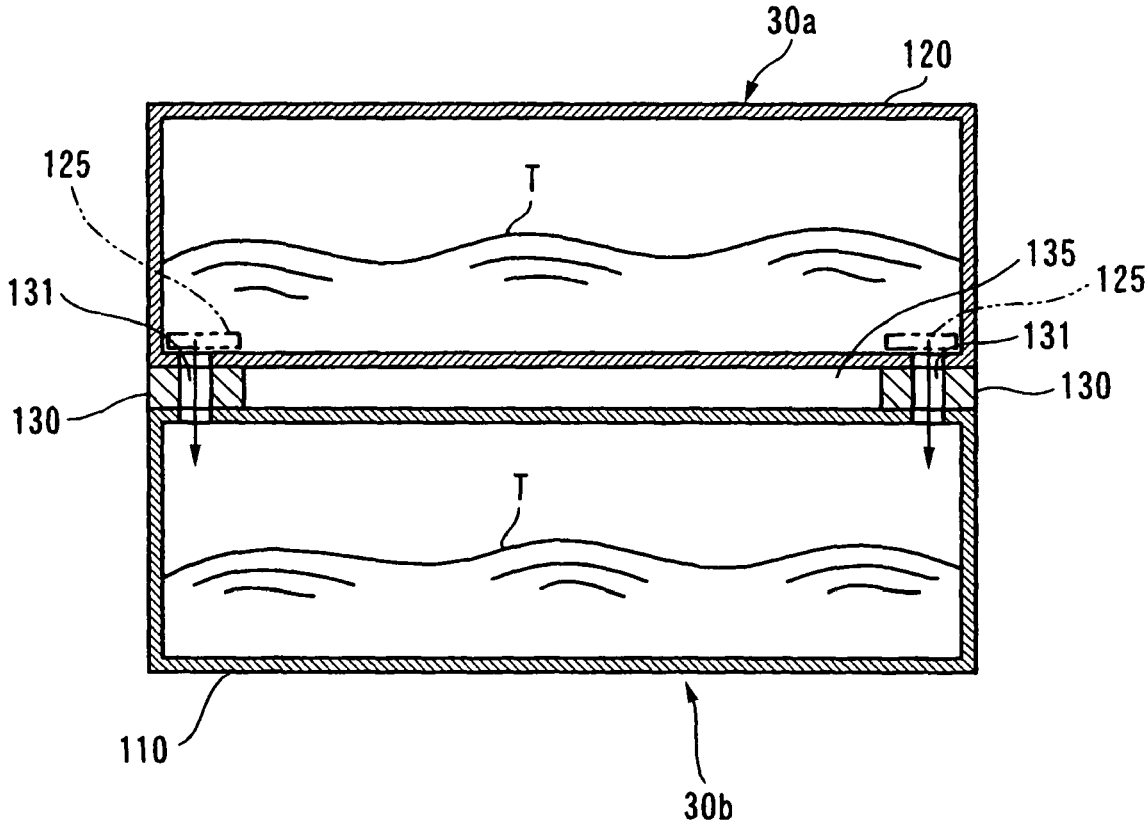
FIG. 8 is an explanatory view showing an example of communicating structure between a main toner supply unit and a sub-toner supply unit.

As a communication structure of the sub-toner supply unit 120 and the main toner supply unit 110, as shown in FIGS. 3 and 8, a spacer 130 made of an elastic member, in which a communication path (toner supply path) 131 is formed, is used. In the embodiment, the spacers 130 are provided at two points on both sides between the units 110 and 120, and the toner supply path 131 is formed in each spacer 130. However, the toner supply path 131 may be formed in either of the spacers 130, or the spacer 130 may be provided at one point on one side and the toner supply path 131 may be formed in this spacer 130.

In the embodiment, when the sub-toner supply unit 120 is not used, it is preferable that the joint portion to the toner supply path 131 is closed by a seal member 125 which can be opened in use as shown by an imaginary line in FIG. 8. In this case, when the process cartridge 30 is not used (for example, in conveyance), there is no fear that the toner in the sub-toner supply unit 120 enters the toner supply path 131 and causes cogging. Further, it is possible to effectively prevent that the toner in the sub-toner supply unit 120 is filled into the main toner supply unit 110 in an offset state thereby to increase unnecessarily the filling concentration of the toner in the main toner supply unit 110.

In the embodiment, when the predetermined amount of the toner T is supplied from the main toner supply unit 110 to the development unit 100, simultaneously, the toner T in the sub-toner supply unit 120 is supplemented to the main toner supply unit 110. Therefore, the main toner supply unit 110 is filled with the nearly constant amount of the toner T till the sub-toner supply unit 120 empties, so that change in weight of the development cartridge 30*b* is kept low.

At this time, since the photoconductor cartridge 30*a* is positioned and fixed to the cartridge reception part of the apparatus housing 21, change in the toner housing amount of the sub-toner supply unit 120 does not give any influence to the change in weight of the development cartridge 30*b*.

Therefore, till the sub-toner supply unit 120 empties, the variation of pressure applying power of the development cartridge 30*b* to the photoconductor cartridge 30*a* is suppressed. Correspondingly, image trouble can be effectively prevented.

Further, since the photoconductor cartridge 30*a* is positioned and fixed to the apparatus housing 21, at least the downside position of the photoconductor cartridge 30*a* forming the scanning path 135 does not change. Therefore, even if the position of the development cartridge 30*b* supported swingably by the photoconductor cartridge 30*a* changes, there is little fear that the scanning path 135 is obstructed.

Cleaning Device

Figure 9:
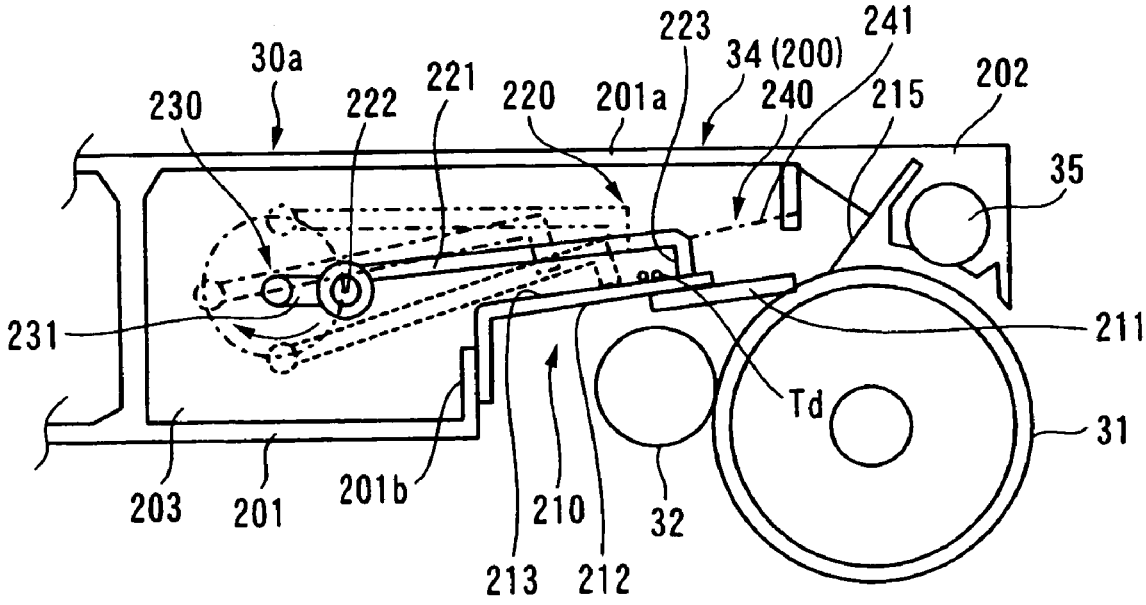
FIG. 9 is an explanatory view showing a main portion of a cleaning device used in the embodiment.

Further, in the embodiment, the cleaning device 34, as shown in FIG. 9, is incorporated into the photoconductor cartridge 30*a* as the cleaning unit 200.

This cleaning unit 200 includes a cleaning housing 201 which opens opposed to the photoconductor drum 31, uses the inside of this cleaning housing 201 as a waste toner housing room 203 in which waste toner can be housed, and is formed by extending an upper wall 201*a* of the cleaning housing 201 toward the photoconductor drum 31 side in the shape of an eaves.

At an opening lower edge 201*b* of this cleaning housing 201, a cleaning blade 210 is provided. In this cleaning blade 210, a nearly L-shaped blade holder 212 is attached to side wall portions (not shown) hanging down from both sides of the opening lower edge 201*b* and the upper wall 201*a* of the cleaning housing 201, a blade body 211 made of an elastic member such as urethane rubber is attached to a leading end outside of this blade holder 212, and a leading end of this blade body 211 is brought into elastic contact with the photoconductor drum 31 so as to be opposed to the rotary direction (counterclockwise direction in FIG. 9) of the photoconductor drum 31.

On the other hand, at an opening upper edge of the cleaning housing 201 (near a leading end of the upper wall 201*a* in the embodiment), a film seal 215 made of polyurethane is provided. A leading end portion of this film seal 215 is brought into elastic contact with the photoconductor drum 31 in the rotary direction of the drum 31 thereby to prevent scatter of the waste toner collected by the cleaning blade 210.

In the embodiment, the portion other than the attached portion of the cleaning blade 210 to the cleaning housing 201 is arranged nearly in parallel to the eaves-shaped portion of the upper wall 201*a* of the cleaning housing 201, and used as a waste toner storing part 213 (corresponding to the blade holder 212 inner surface in this example) in which the waste toner scraped by the cleaning blade 210 is temporarily stored. Particularly, in this example, the waste toner storing part 213 slopes down toward the waste toner housing room 203, which can improve transportability of the waste toner Td.

Further, in the embodiment, though the waste toner storing part 213 is formed by only the cleaning blade 210, it may be formed by using also a part of the cleaning housing 201 together with the cleaning blade 210.

Further, between this cleaning housing 201 and the cleaning blade 210, a recess space for the photoconductor drum 31 is secured, and the charge roll 32 is arranged using this recess space.

At the leading end of the upper wall 201*a* of the cleaning housing 201, a holding block 202 for the erasing lamp 35 is provided.

Further, in the embodiment, in the cleaning housing 201, a waste toner transporting member 220 is provided, which transports the waste toner Td scraped by the cleaning blade 210 to the waste toner housing room 203 side.

This waste toner transporting member 220 includes a transporting plate 221 as a member element extending from the waste toner housing room 203 to the waste toner storing part 213. At an end on the waste toner housing room 203 side of this transporting plate 221, a drive input part 222 which can input drive power from the external portion is provided; and at an end of the photoconductor drum 31 side of the transporting plate 221, a protrusion part 223 which can come into contact with the waste toner storing part 213 is provided.

Here, the transporting plate 221 may be a plate-shaped member. However, from viewpoints of weight reduction and effective prevention of accumulation of the waste toner Td on the upper surface portion, it is preferable that an opening 224 is provided in another portion than the protrusion part 223 of the transporting plate 221 and the drive input part 222. Further, the forming position of the protrusion part 223 must not be always the end portion of the transporting plate 221 but may be a portion distant from the end portion. Further, though the number of the protrusion parts 223 should be at least one, the plural protrusion parts 223 may be provided. Further, the protrusion part 223 may be formed by bending the leading end of the transporting plate 221, or may be formed at a part of the transporting plate 221 integrally or separately.

Further, the member element of the waste toner transporting member 220 must not be always the transporting plate 221, but may use, for example, a flame structure.

In the embodiment, as shown in, for example, FIG. 9, rotary locus-shaped drive power is input to the drive input part 222 of the waste toner transporting member 220. This rotary locus-shaped drive power is readily obtained by rotating a clunk shaft 231 that is a kind of rotation drive mechanism 230 around a rotation center.

Further, in the embodiment, an attitude regulating mechanism 240 for regulating the moving attitude of the waste toner transporting member 220 is additionally provided in the waste toner transporting member 220.

In the embodiment, the attitude regulating mechanism 240 is composed of an energizing spring 241 having one end which fits to the protruding part 223 side of the waste toner transporting member 220 and the other end which fits to a part of the cleaning housing 201, by which the waste toner transporting member is energized in the direction separating from the drive input part 222.

Particularly, in the embodiment, the energizing spring 241 is provided slantingly to the advance or retreat direction of the waste toner transporting member 220.

Figure 10B:
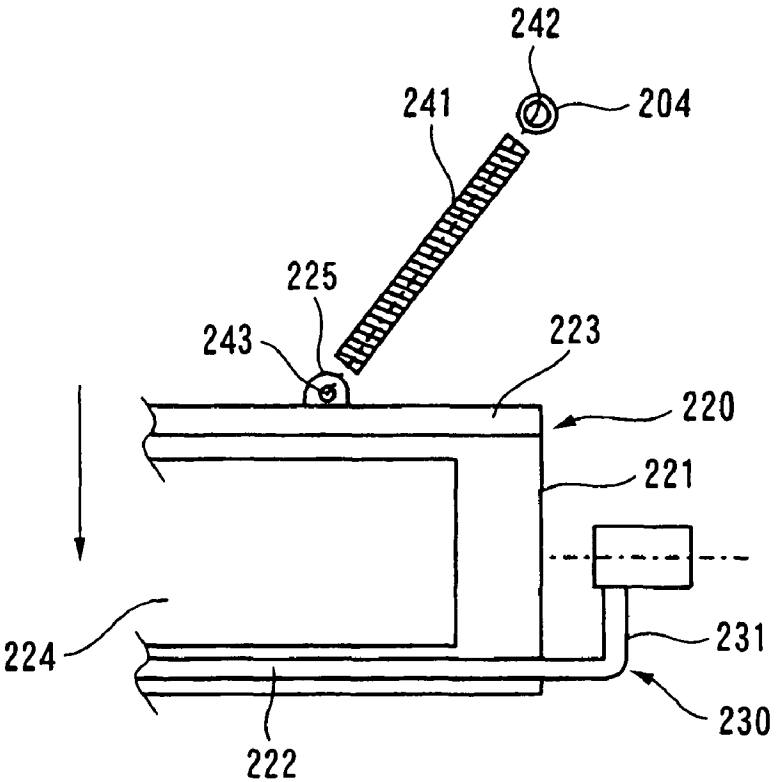
FIGS. 10A and 10B are explanatory views showing operation states of an energizing spring in advance and retreat of a waste toner transporting member.
Figure 10A:
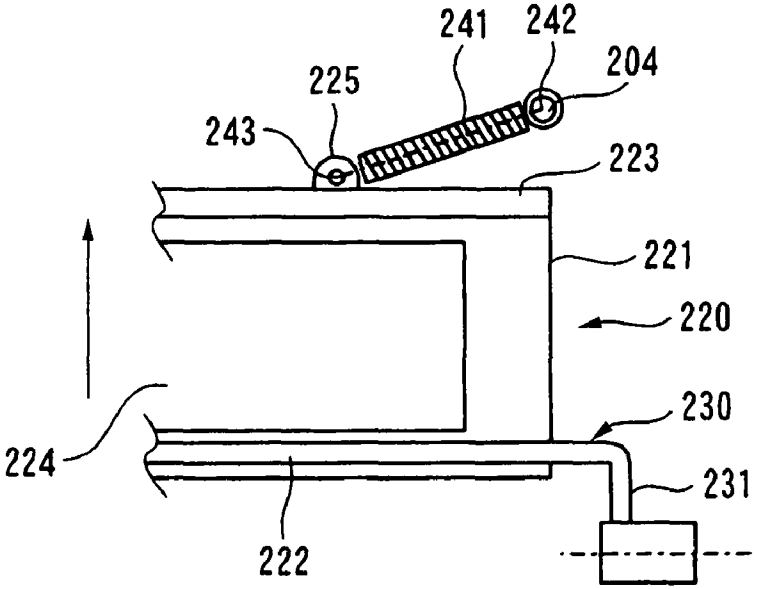

Here, as the attachment structure of the energizing spring 241, as shown in FIGS. 9 and 10, fixing hooks 242 and 243 are provided at both ends of the energizing spring 241, one 242 of the fixing hooks is fitted to a fitting projection 204 on the cleaning housing 201 side, and the other fixing hook 243 is fitted to a fitting piece 225 provided at the end on the protrusion part 223 side of the waste toner transporting member 220.

In the embodiment, though the fitting projection 204 is provided, as the attachment structure of the energizing spring 241, in the cleaning housing 201, the invention is not limited to this. For example, a fitting hole that communicates with the outside may be provided in the cleaning housing 201. Though there is fear of waste toner leakage in this case, this fear is removed by sealing the fitting hole with a seal member. As this seal member, a label stuck to CRU is preferable.

Thus, by additionally providing the energizing spring 241 in the waste toner transporting member 220, as shown in FIGS. 9 and 10, when the rotary locus-shaped drive power is input in the drive input part 222 of the waste toner transporting member 220, with this input, the protruding part 223 of the waste toner transporting member 220 advances or retreats along the waste toner storing part 213.

At this time, the energizing spring 241 regulates the attitude change range of the waste toner transporting member 220 in relation to the positional change of the drive input part 222 of the waste toner transporting member 220. In this example, when the waste toner transporting member 220 retreats, the protrusion part 223 moves along the waste toner storing part 213 while contacting the waste toner; and when the waste toner transporting member 220 advances, the protrusion part 223 moves in a non-contact state with the waste toner on the waste toner storing part 213. The concrete motion will be described later.

Particularly, in the embodiment, since the energizing spring 241 is arranged slantingly to the advance or retreat direction of the waste toner transporting member 220, the arrangement space can be reduced, and the expansion and contraction amount of the energizing spring 241 in relation to the moving amount of the waste toner transporting member 220 can be set small. Since variation of the driving power loads onto the waste toner transporting member can be correspondingly relaxed, this embodiment is preferable.

Next, the operation of the cleaning device 34 used in the embodiment will be described.

Figure 11A:
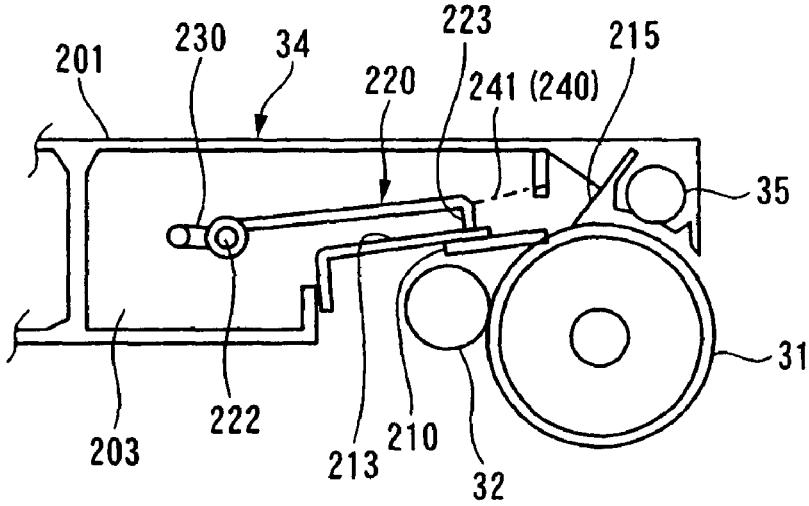
FIGS. 11A and 11C are explanatory views showing operation states in retreat of the waste toner transporting member in the cleaning device according to the first embodiment.

As shown in FIGS. 9 and 11A, when the residual toner on the photoconductor drum 31 is scraped by the cleaning blade 210, the scraped waste toner Td accumulates on and near the cleaning blade 210, and is succeedingly pushed out by the scraped toner. Thereafter, the waste toner Td accumulates on the waste toner storing part 213 (on the inner surface of the blade holder 211 in this example).

Under this state, when the drive input part 222 of the waste toner transporting member 220 is in a position shown by FIG. 11A, the waste toner transporting member 220 is arranged in the advancemost position.

At this time, the energizing spring 241 energizes the waste toner transporting member 220 in the direction separating from the drive input part 222. However, by adjusting a relation between the drive input part 222 position of the waste toner transporting member 220 and the fixing point position of the energizing spring 241 on the cleaning housing 201 side, a part of the energizing power components of the energizing spring 241 acts in the direction where the protrusion part 223 of the waste toner transporting member 220 is brought into contact with the waste toner on the waste toner storing part 213. Hereby, the protrusion part 223 of the waste toner transporting member 220 comes into contact with the waste toner on the waste toner storing part 213.

Figure 11B:
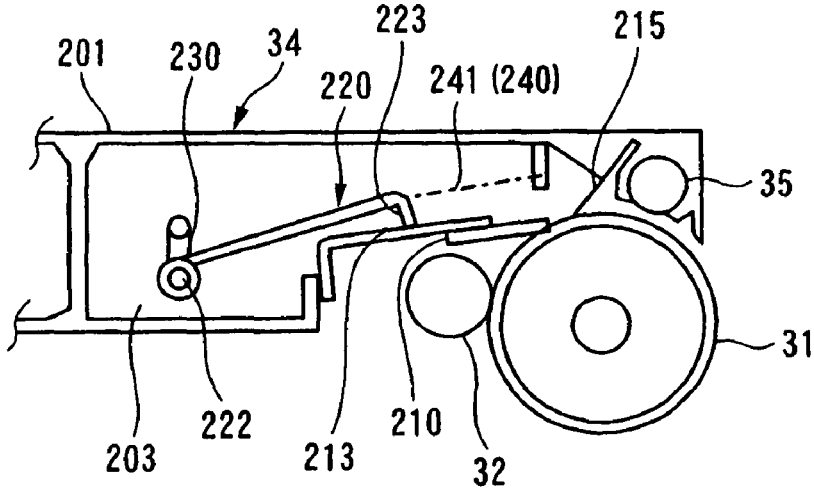

As the drive input part 222 position is rotated downward from this state by the rotation drive mechanism 230, the waste toner transporting member 220, as shown in FIG. 11B, gradually retreats while slanting. At this time, the protrusion part 223 of the waste toner transporting member 220 transports the waste toner on the waste toner storing part 213 toward the waste toner housing room 203 side.

When the drive input part 222 of the waste toner transporting member 220 reaches the downmost point, the attitude of the waste toner transporting member 220 enters the most sharply slant state. In this case, from a viewpoint of keeping the contact state between the protrusion part 223 of the waste toner transporting member 222 and the waste toner storing part 213, it is efficient to bring the other portions of the waste toner transporting member 220 than the protrusion part 223 into non-contact with the waste toner storing part 213.

Thereafter, when the drive input part 222 of the waste toner transporting member 220 rotates up to the position shown in FIG. 1C, the waste toner transporting member 220 more retreats while relaxing the slant attitude gradually. At this time, since the energizing spring 241 is acting yet so as to press the waste toner transporting member 220 on the waste toner storing part 213 side, the protrusion part 223 of the waste toner transporting member 220 moves along the waste toner storing part 213 in the contact state with the waste toner Td thereby to move the waste toner Td to the waste toner housing room 203 side.

Figure 11C:
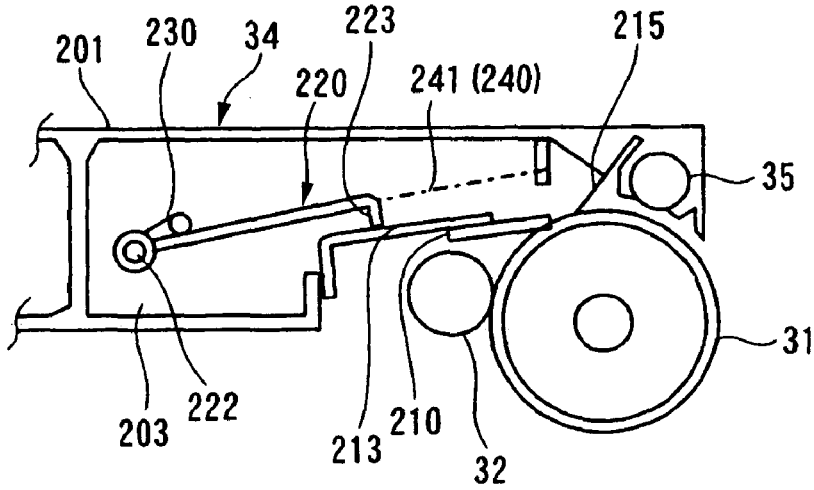
Figure 12A:
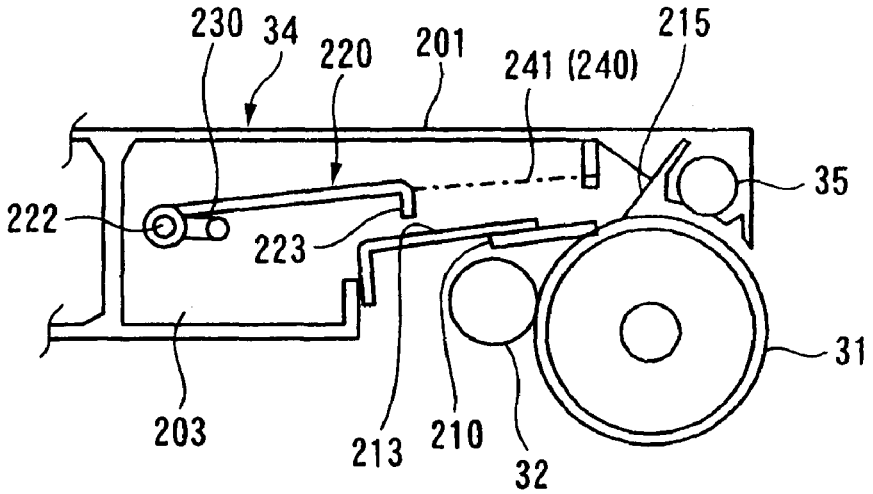
FIGS. 12A and 12C are explanatory views showing operation states in advance of the waste toner transporting member.

In the embodiment, as shown in FIGS. 11C and 12A, even in case that the waste toner transporting member 220 reaches the retreatmost position, the protrusion part 223 of the waste toner transporting member 220 does not move to the end close to the waste toner housing room 203 of the waste toner storing part 213. However, the waste toner transported near the end close to the waste toner housing room 203 of the waste toner storing part 213 is pushed by the waste toner transported sequentially, and housed into the waste housing room 203 in order.

Further, in the embodiment, as shown in FIG. 12A, when the waste toner transporting member 220 reaches the retreatmost position, it is pulled by the energizing power of the energizing spring 241, and the protrusion part 223 of the waste toner transporting member 220 separates from the waste toner on the waste toner storing part 213 and enters the state immediately before the protrusion part 223 is arranged in the non-contact state.

Namely, since the waste toner transporting member 220 is energized in the predetermined direction by the energizing spring 241, on the basis of the relation between the drive input part 222 position of the waste toner transporting member 220 and the fixing point position on the cleaning housing 201 side of the energizing spring 241, the arrangement attitude of the waste toner transporting member 220 is determined. At this time, in the stage in which the waste toner transporting member 220 proceeds to the advance movement, such a layout that the protrusion part 223 of the waste toner transporting member 220 is arranged in the non-contact state with the waste toner on the waste toner storing part 213 is necessary.

Figure 12B:
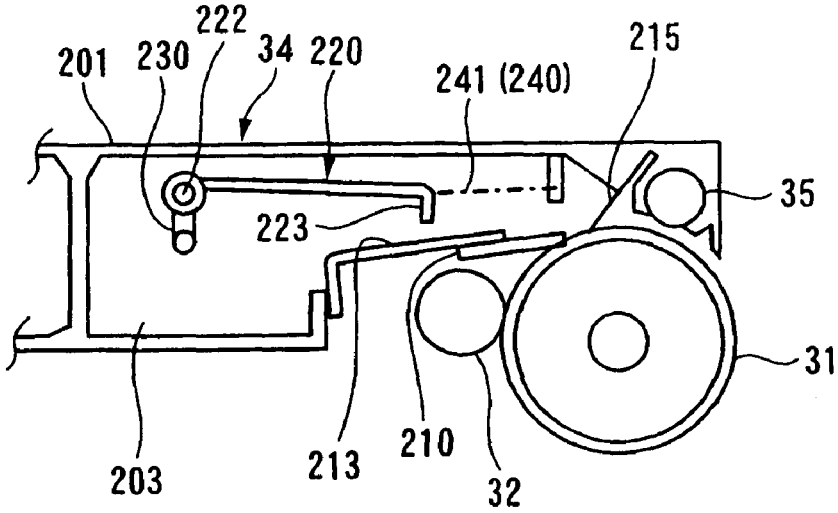

Thereafter, as shown in FIG. 12B, when the drive input part 222 of the waste toner transporting member 220 rotates upward, the waste toner transporting member 220 advances, while changing the slant attitude so that the drive input part 222 side ascends.

At this time, since the waste toner transporting member 220 is energized by the energizing spring 241, when the drive input part 222 position of the waste toner transporting member 220 becomes high, the arrangement position of the waste toner transporting member 220 becomes further high. Therefore, the protrusion part 223 of the waste toner transporting member 220 remains arranged in the non-contact state with the waste toner on the waste toner storing part 213.

Figure 12C:
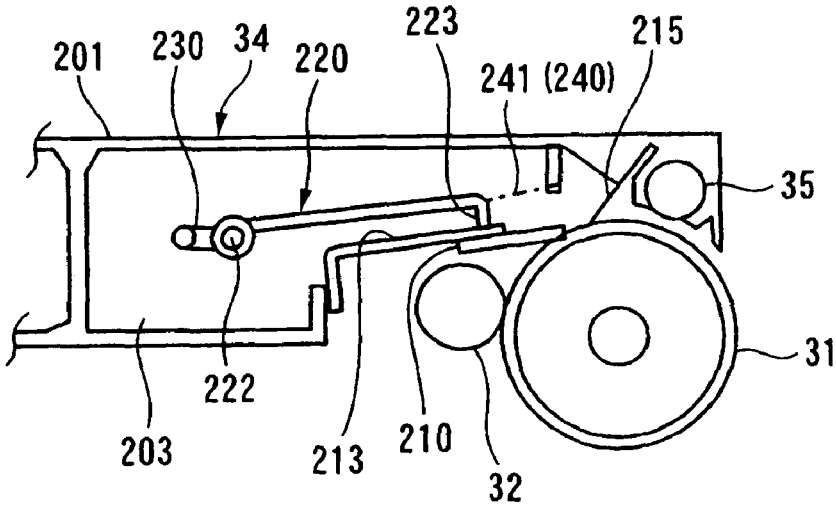

Thereafter, as shown in FIG. 12C, when the drive input part 222 of the waste toner transporting member 220 rotates from the upper dead centre position in the descending direction, the waste toner transporting 220 advance while changing the slant attitude again, and gradually comes close to the waste toner storing part 213 side. When the waste toner transporting member 220 reaches the advancemost position, the protrusion part 223 of the waste toner transporting member 220 is arranged again in the contact state with the waste toner on the waste toner storing part 213.

Thus, since the protrusion part 223 of the waste toner transporting member 220 moves in the non-contact state with the waste toner on the waste toner storing part 213 when the waste toner transporting member 220 advances, it is effectively prevented that the waste toner on the waste toner storing part 213 is pushed back with the advance operation of the waste toner transporting member 220, so that transportability of the waste toner is kept good.

Thereafter, the motions shown in FIGS. 11A to 11C, and FIGS. 12A to 12C are repeated.

In the embodiment, the waste toner transporting member 220, throughout the retreating time, moves while contacting the waste toner storing part 213. However, the invention is not limited to this. For example, in the retreat area, firstly the waste toner transporting member 220 may move while not contacting the waste toner storing part 213, and halfway the waste toner transporting member 220 may move while contacting the waste toner storing part 213.

Particularly, in the embodiment, the waste transporting member 220, when the drive input part 222 is located in the upper dead centre position, keeps the nearly horizontal uppermost attitude, and moves in a locus in which the member 220 does not protrude upward from this uppermost attitude. Further, since the waste toner transporting member 220 advances while keeping the nearly horizontal attitude, it is possible to set narrow the space on the upper portion side of the waste toner housing room and the upper space of the waste toner storing part 213, so that the cleaning device 34 can be slimmed down.

Further, in the embodiment, since the waste toner transporting member 220 has the opening 224, there is no fear that the waste toner accumulates on the waste toner transporting member 220 in the waste toner transportation by the waste toner transporting member 220, and there is also no fear that the waste toner scatters due to wind pressure by air resistance.

Further, in the embodiment, though the waste toner transporting member 220, in the retreating time, moves in contact along the waste toner storing part 213, the invention is not limited to this. The waste toner transporting member 220, though does not contact the waste toner storing part 213, may move while contacting the waste toner on the waste toner storing part 213. In this case, since the waste toner transporting member 220, in the retreating time, does not contact directly the waste toner storing part 213, there is little fear that vibration is unnecessarily transmitted to the photoconductor drum 31 side with the movement of the waste toner transporting member 220. Therefore, from this point, the embodiment is preferable.

Drive System of Development Device and Cleaning Device

In the embodiment, it is safe to select appropriately a drive system 300 of the development device 33 and the cleaning device 34. For example, the following is used as the drive system.

Figure 13:
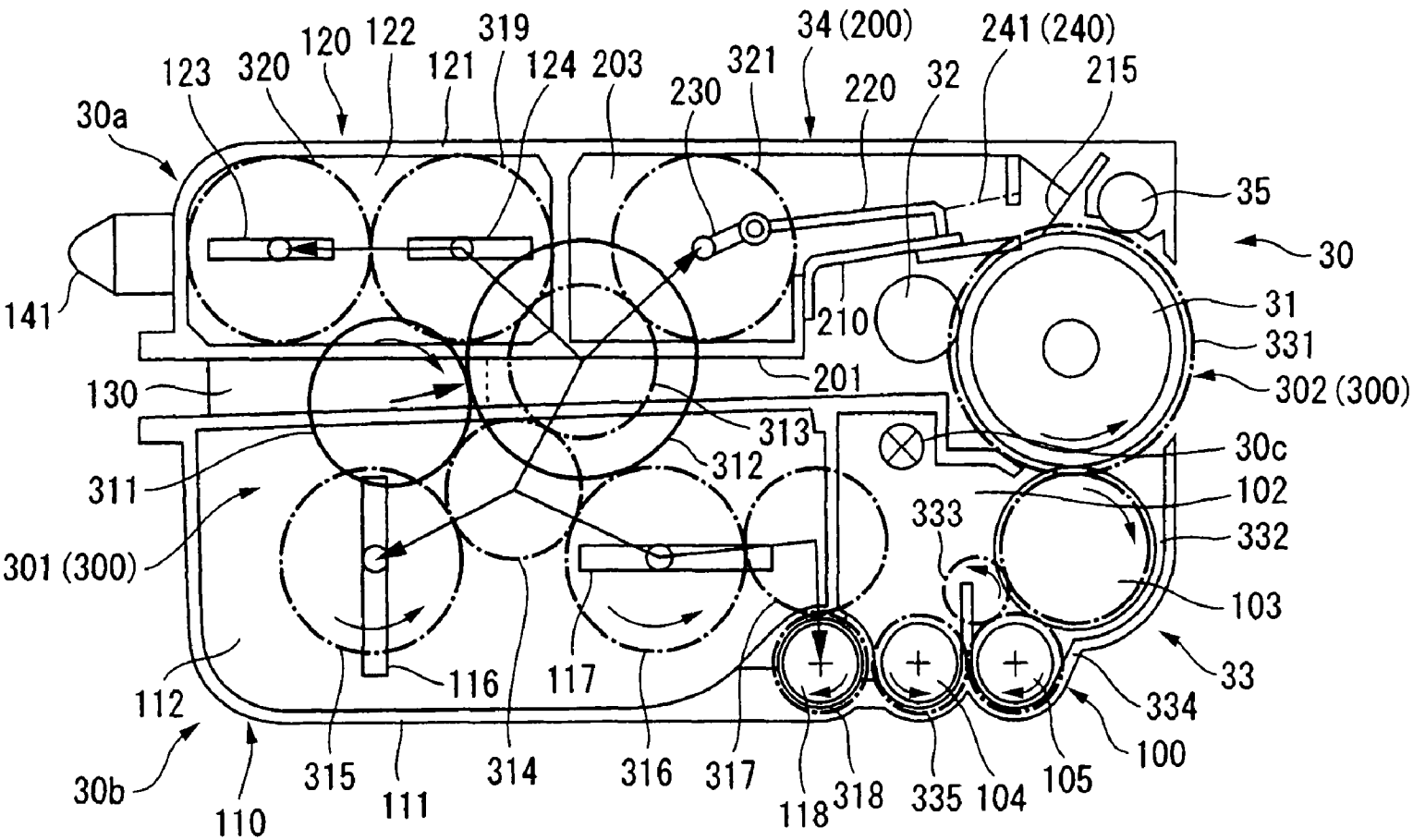
FIG. 13 is an explanatory view showing an example of a transportation drive system and a development drive system used in the embodiment.

Namely, the drive system 300 used in the embodiment, as shown in FIG. 13, includes a transportation drive system 301 which drives, by the same drive source, each driven element of the toner supply units 110, 120 in the development device 33, and each drive element of the cleaning unit 200 as the cleaning device 34; and a development drive system 302 which drive, by another drive source than the drive source in this transportation drive system 301, each drive element of the development unit 100 in the development device 33.

Here, the transportation drive system 301 includes a drive input gear 311 coupled to a not-shown drive source, brings a drive transmission gear 312 of a first stage into mesh with this drive input gear 311, sets a coaxial transmission gear 313 which is coaxial to this drive transmission gear 312, brings drive transmission gears 315 and 316 connected to the agitators 116 and 117 of the main toner supply unit 110 into mesh with this coaxial transmission gear 313 through an idler gear 314, and further brings a dispensing gear 318 connected to the dispensing auger 118 into mesh with the drive transmission gear 316 through an idler gear 317.

Further, this transportation drive system 301 brings drive transmission gears 319 and 320 connected to the agitators 123 and 124 of the sub-toner supply unit 120 into mesh with the coaxial transmission gear 313, and also brings a drive transmission gear 321 connected to the rotary shaft of the rotation drive mechanism 230 in the cleaning unit 200 into mesh with the coaxial transmission gear 313.

On the other hand, the development drive system 302 includes a drive transmission gear 331 which is coaxial to the photoconductor drum 31, brings a drive transmission gear 332 connected to the development roll 103 into mesh with this drive transmission gear 331, and further brings, in order, drive transmission gears 334 and 335 connected to the agitating and transporting augers 105 and 104 into mesh with this drive transmission gear 332 through an idler gear 333.

Further, the drive source of the development drive system 302 may be different from the drive source of the transportation drive system 301, or the same drive source may be used as long as it can drive individually each drive system.

Thus, according to the embodiment, the transportation drive system 301 and the development drive system 302 are the different drive systems. Therefore, compared with the aspect in which the transportation drive system 301 and the development drive system 302 are cooperated, it is not necessary to drive always, in the development operation, the toner transporting members (agitators 116, 117, dispensing auger 118, and agitators 123, 124), and the waste toner transporting member 220. Accordingly, wear-out deterioration of the toner transporting member and the waste toner transporting member 220 can be suppressed, so that lift of the process cartridge 30 can be improved.

Further, since the toner transporting member and the waste toner transporting member 220 which are large in load variation are driven separately from the photoconductive drum 31 and the development roll 103 which require rotary accuracy, the vibration caused by the load variations of the toner transporting member and the waste toner transporting member 220 does not affect the rotations of the photoconductor drum 31 and the development roll 103, so that the image defect can be previously prevented.

Further, by providing a connective and disconnective element (oscillation gear) which can connect and disconnect the drive to each drive element of the toner supply units 110, 120, only the waste toner transporting operation can be performed separately from the toner supplying operation. Further, by providing a connective and disconnective element which can connect and disconnect the drive to a part of the drive elements of the toner supply unit 110, for example, the dispensing auger 118, the toner supplying operation by the dispensing auger 118 is not performed, but only the toner agitating and transporting operation by the agitators 116, 117, 123, and 124 in the toner supply units 110 and 120, whereby the supply toner can be periodically disentangled.

Embodiment 2

Figure 14A:
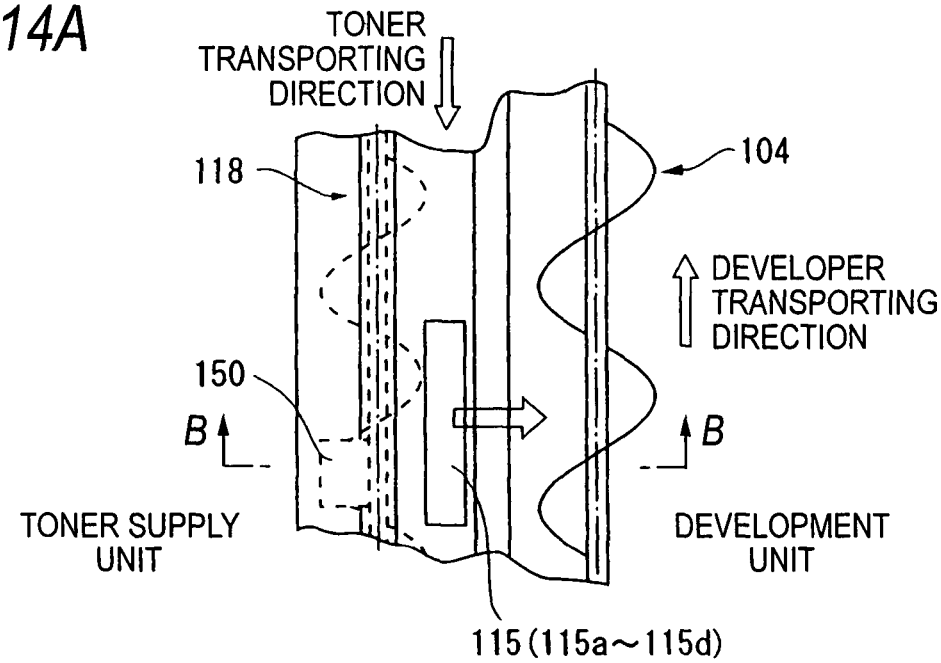
FIG. 14A is an explanatory view showing the structure around a toner supply port in a development device according to a second embodiment of the invention.
Figure 14B:
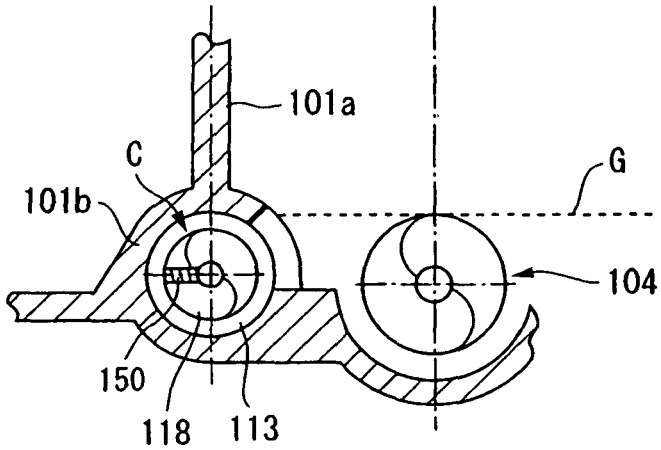
FIG. 14B is a sectional view taken on a line B-B in FIG. 14A.
Figure 14C:
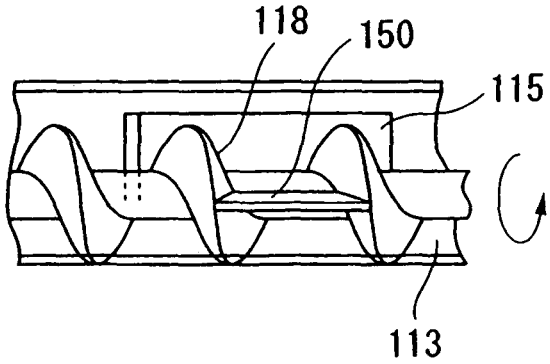
FIG. 14C is a diagram viewed from a C-direction in FIG. 14B.

FIGS. 14A to 14C show the structure around a toner supply port of a development device according to a second embodiment to which the invention is applied.

In the drawings, the basic constitution of the structure around the toner supply port is nearly the same as that in the first embodiment. Namely, a toner supply port 115 opens so that its lower end is located in the lower position than the surface position of developer G housed in a developer housing room 102. However, the second embodiment is different from the first embodiment in that a push-out paddle 150 along the axial direction is provided for the portion of a dispensing auger 118 faced to the toner supply port 115. The components similar to those in the first embodiment are denoted by the same reference numerals, and their detailed description is omitted. This is similar also in following embodiments.

According to the embodiment, near the toner supply port 115, supply toner T is pushed out by the push-out paddle 150 from the toner supply port 115 to the developer housing room 102. Therefore, the toner T is supplied from the lateral side to the developer G in the developer housing room 102, and agitated and mixed by an admixing auger 104.

Using the development device according to the embodiment, a process cartridge and an image forming apparatus may be constructed. This is similar also in following embodiments.

Embodiment 3

Figure 15A:
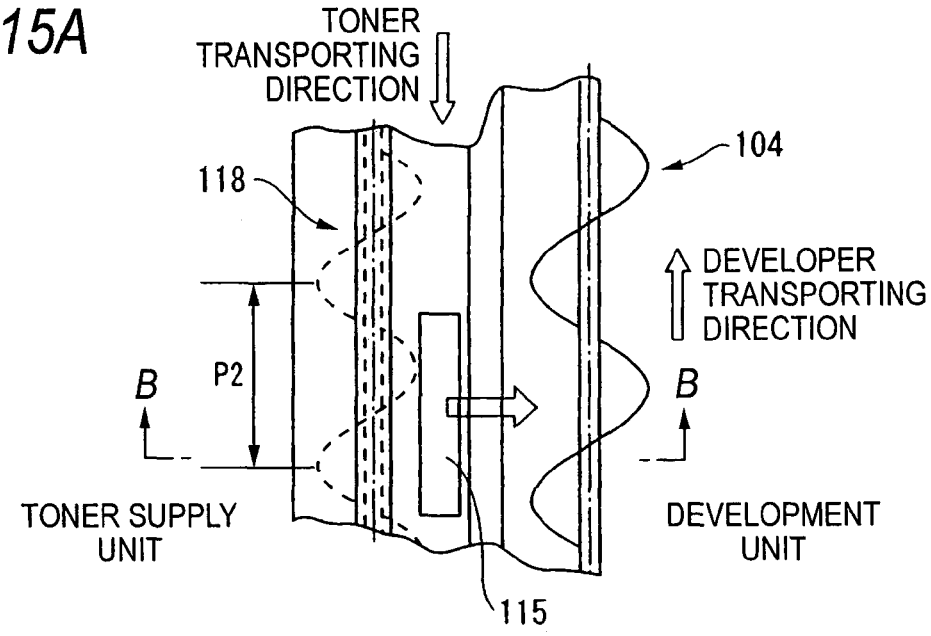
FIG. 15A is an explanatory view showing the structure around a toner supply port in a development device according to a third embodiment of the invention.
Figure 15B:
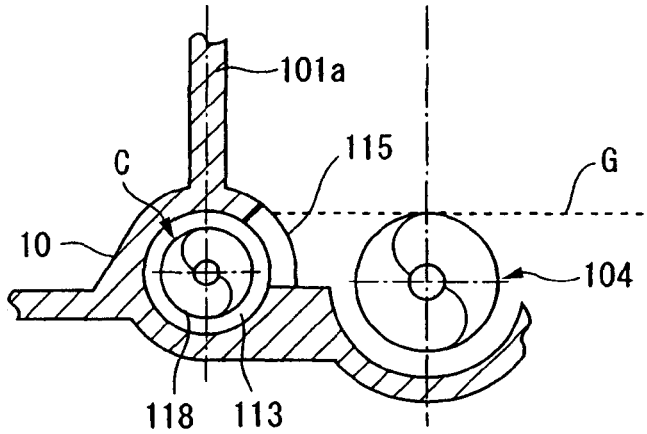
FIG. 15B is a sectional view taken on a line B-B in FIG. 15A.
Figure 15C:
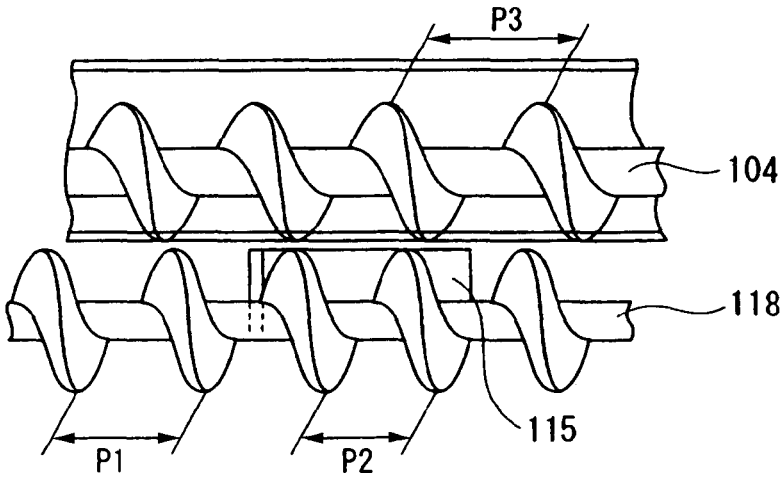
FIG. 15C is a diagram viewed from a C-direction in FIG. 15B.

FIGS. 15A to 15C show the structure around a toner supply port of a development device according to a third embodiment to which the invention is applied.

In the drawings, the basic constitution of the structure around the toner supply port is nearly the same as that in the first embodiment. Namely, a toner supply port 115 opens so that its lower end is located in the lower position than the surface position of developer G housed in a developer housing room 102. However, the third embodiment is different from the first embodiment in that an auger vane pitch P2 of the portion faced to the toner supply port 115, of a dispensing auger 118 is set narrower than an auger vane pitch P1 for toner transportation. In this example, the pitch P1 is set to about 4 to 10 mm, and the pitch P2 is set to a value smaller than the value of P1 by about 2 to 6 mm. Further, it is preferable that an auger vane pitch P3 of an admixing auger 104 is larger than the pitch P1 in consideration of the toner internal pressure and agitation power by the dispensing auger 118.

According to the embodiment, near the toner supply port 115, the auger vane pitch P2 is set narrower than the auger vane pitch P1. Therefore, toner filling concentration in the portion in a dispensing room 113 faced to the toner supply port 115 increases, and supply toner T is supplied, by push-out action by the auger vane pitch P2 portion, through the toner supply port 115 to developer G in the developer housing room 102 from the lateral side. In result, the supply toner T does not float on the developer G but is surely agitated and mixed with the existing developer G by the admixing auger 104.

In the embodiment, though the vane pitch P2 of the dispensing auger 118 is set narrow, for example, by combination with the aspect in the first embodiment (auger vane for weir), the toner filling concentration in the portion in the dispensing room 113 faced to the toner supply port 115 can be increased more.

Embodiment 4

Figure 16:
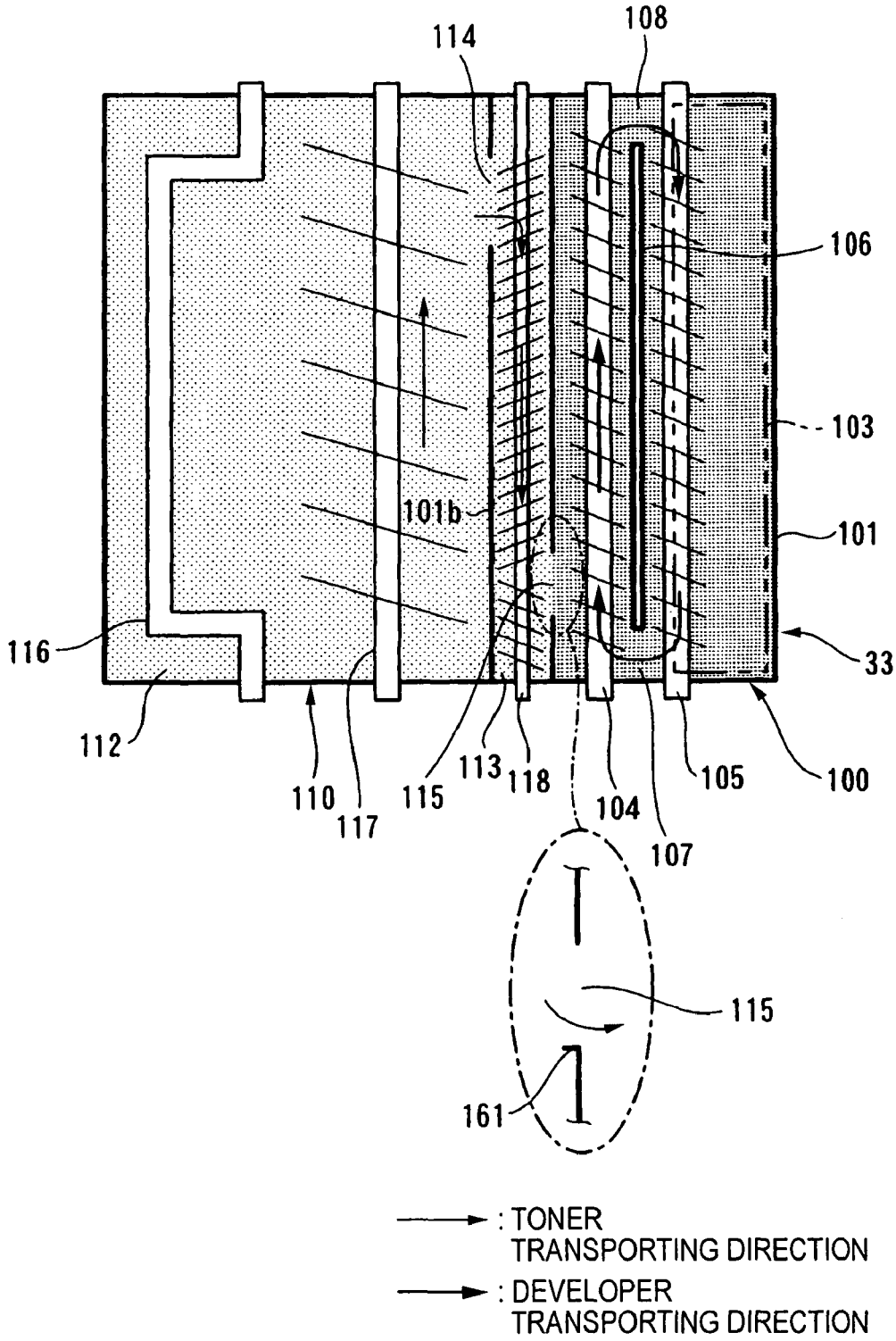
FIG. 16 is an explanatory view showing a development device according to a fourth embodiment of the invention.

FIG. 16 is an explanatory view (corresponding to FIG. 6) showing a development device according to a fourth embodiment to which the invention is applied.

In the drawing, the basic constitution of a development device 33 is nearly the same as that in the first embodiment. However, the fourth embodiment is different from the first embodiment in that the structure different from that in the first embodiment is added to a toner supply port 115 edge.

In this embodiment, of the toner supply port 115 edge, at a toner transporting direction downstream side edge of the portion faced to the toner supply port 115, an eaves-shaped return part 161 faced to the transporting direction of toner T is protrusively provided.

According to the embodiment, this eaves-shaped shaped return part 161 protrudes to the dispensing room 113 side, and functions as a guide which exhausts the toner in the dispensing room 113 to the toner supply port 115 side, so that the toner can be stably supplied from the toner supply port 115.

Further, in case that such the eaves-shaped return part 161 protrudes too much, an obstruction occurs in the original transporting operation of the toner T. Therefore, within the range in which the obstruction does not occur, the protruding amount of the part 161 should be appropriately selected. Namely, by appropriately selecting the protruding amount of this eaves-shaped return part 161, the supply of the toner T is smoothly performed.

Embodiment 5

Figure 17:
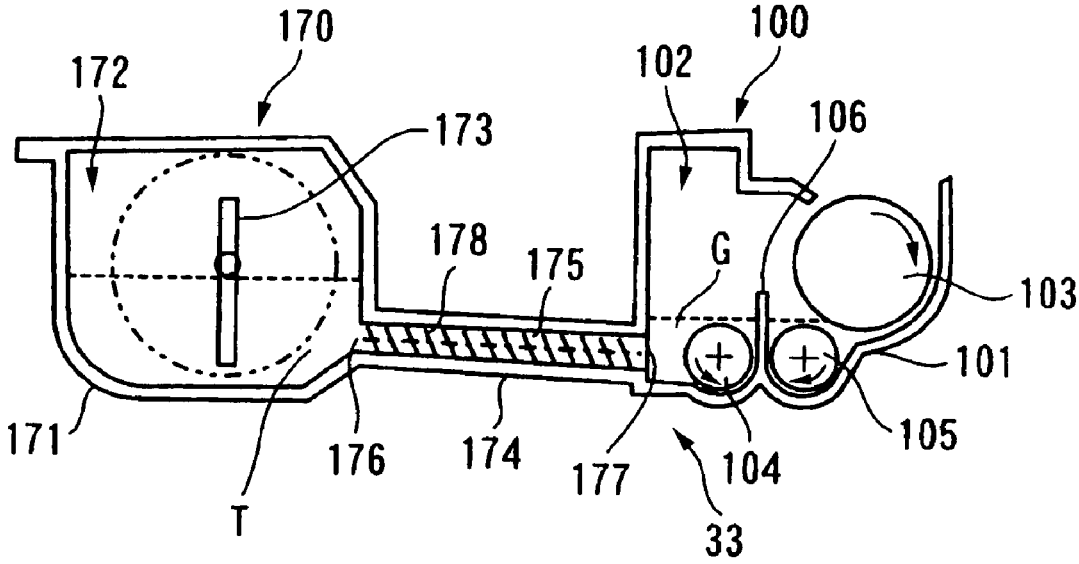
FIG. 17 is an explanatory view showing a development device according to a fifth embodiment of the invention.
Figure 18:
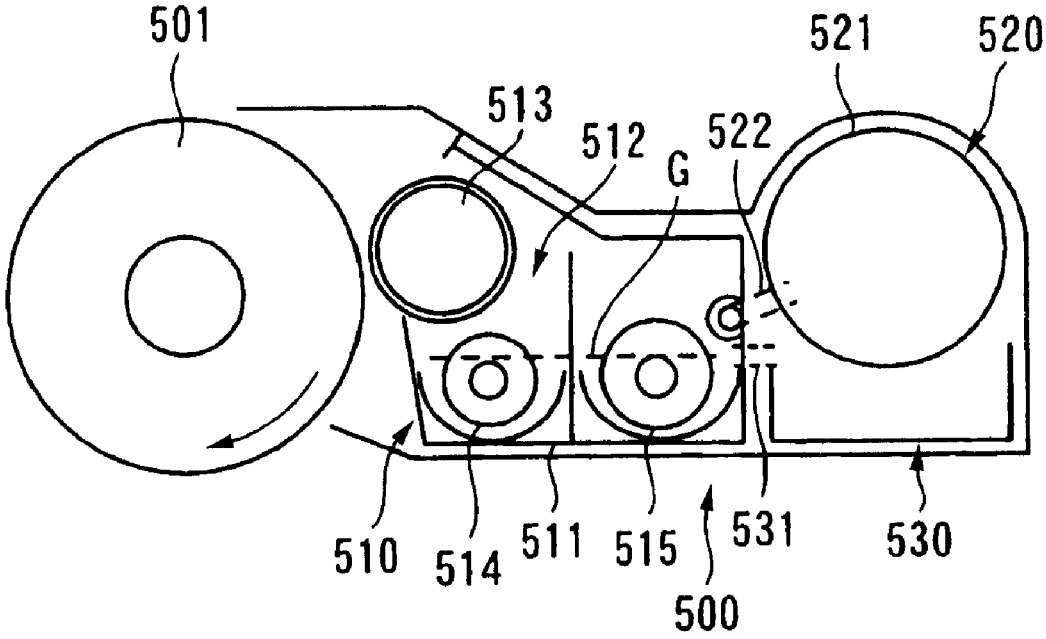
FIG. 18 is an explanatory view showing an example of conventional development devices.
Figure 19A:
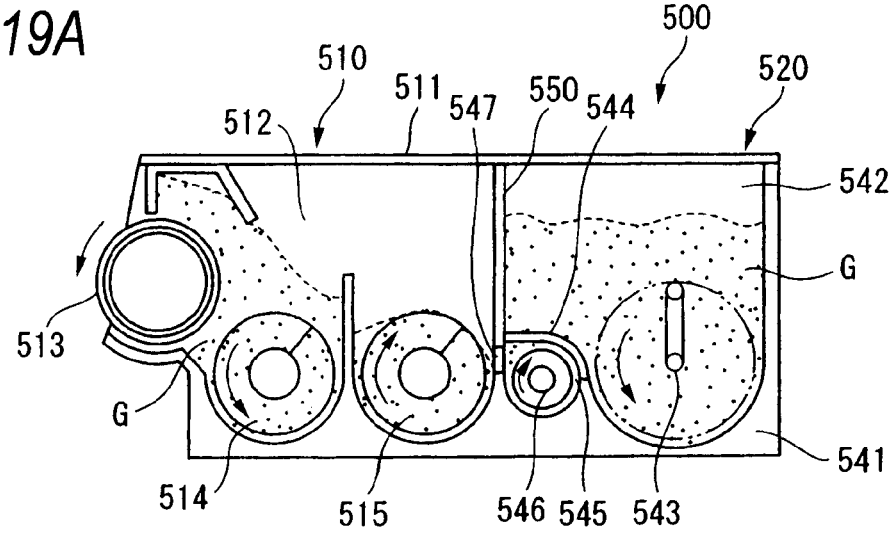
FIG. 19A is an explanatory view showing another example of the conventional development devices.
Figure 19B:
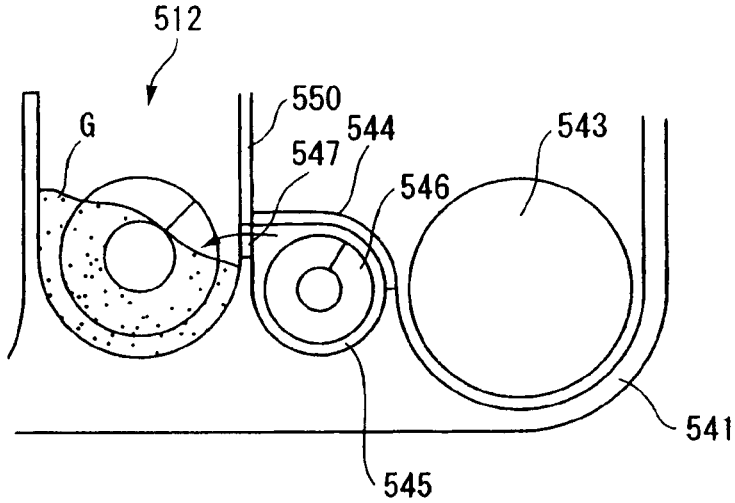
FIG. 19B is an explanatory view showing a developer supply mechanism of the development device in FIG. 19A.
Figure 19C:
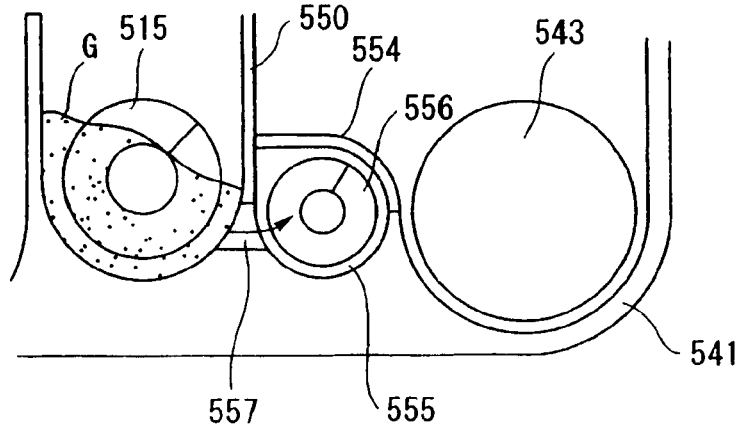
FIG. 19C is an explanatory view showing a developer pick-up mechanism of the development device in FIG. 19A.

FIG. 17 shows a development device according to a fifth embodiment to which the invention is applied.

In the drawing, a development device 33 communicates and connects a development unit 100 and a toner supply unit 170 through a toner supply port 177. The fifth embodiment is different from the first to fourth embodiments in that a transporting direction of toner supplied from the toner supply unit 170 to the development unit 100 is along the direction orthogonal to the axial direction of a development roll 103 of a developer housing room 102 in the development unit 100.

Namely, in the embodiment, the development unit 100 includes the nearly similar components to those in the first embodiment (development housing 101, developer housing room 102, development roll 103, agitation and transporting augers 104, 105, partition wall 106, and communication ports 107, 108 (refer to FIG. 6)).

On the other hand, the toner supply unit 170 includes a toner housing 171, sets in this toner housing 171 a toner housing room 172 in which supply toner is housed, set an agitating and transporting agitator 173 in this toner housing room 172, sets a coupling duct 174 between the toner housing 171 and the developing housing 101 at one sides in their longitudinal directions thereby to couple the toner housing 171 and the developing housing 101, secures a dispensing room 175 in this coupling duct 174, provides a dispensing room entrance opening 176 and a toner supply port 177 respectively near the communication port 107 of the toner housing 171 side wall of the dispensing room 175 and the development housing 101 side wall (refer to FIG. 6), and sets a dispensing auger 178 for supplying toner quantitatively in the dispensing room 175.

Particularly, in the embodiment, a toner supply port 177 opens so that its lower end is located in the lower position than the surface position of developer G housed in the developer housing room 102, and so that its upper end is located in the lower position than the upper ends of the agitating and transporting augers 104 and 105.

Therefore, according to the embodiment, the toner supply unit 170 supplies toner T in the toner housing room 172 through the dispensing room 175 to the developer housing room 102 of the development unit 100.

At this time, near the toner supply port 177, the toner in the dispensing room 175 is supplied by push-out power of the dispensing auger 178 through the toner supply port 177 to the developer housing room 102 from the lateral direction, whereby the toner is agitated and mixed by the admixing auger 104 with the existing developer G.

What is claimed is:

1. A development device comprising:

developer composed of toner and carrier;

a development unit which includes a developer housing room in which the developer composed of toner and carrier is housed, a developer agitating and transporting member in the developer housing room, and a developer bearing member which can bear and transport the developer agitated and transported by the developer agitating and transporting member;

supply toner; and a toner supply unit which includes a toner supply room in which at least the supply toner is housed, a toner transporting member in the toner supply room, and a toner supply port, wherein the toner supply room communicates with the developer housing room of the development unit through a toner supply port, wherein the toner supply port of the toner supply unit opens so that its lower end is located in a lower position than a surface position of the developer positioned at a position contacting with the toner supply port and housed in the developer housing room;

wherein press power by which the supply toner in the toner supply unit is pushed out from the toner supply port is larger than the internal pressure of the developer in the developer housing room;

wherein the toner supply room includes a dispensing room which is formed at the portion faced to the toner supply port and can supply the supply toner quantitatively, a dispensing member for quantitative supply as a toner transporting member in the dispensing room, and includes a dispensing room entrance opening at a communication portion with the dispensing room, and wherein the dispensing member is an auger provided with an agitating and transporting vane and a vane for weir around a rotation shaft of the auger;

wherein the lower end of the toner supply port is located in a position lower than a rotation center of the developer agitating and transporting member;

wherein the toner supply port of the toner supply unit communicates the dispensing room of the toner supply unit with the developer housing room of the development unit;

wherein the toner supply port of the toner supply unit opens at a position which faces a boundary between the agitating and transporting vane provided in the dispensing member and the vane for weir provided in the dispensing member.

2. The development device according to claim 1, wherein the toner transporting member faces the toner supply port, and the portion faced to the toner supply port, of the toner transporting member is formed as a push-out part by which the toner can be pushed out toward the toner supply port.

3. The development device according to claim 1, wherein the dispensing room entrance opening is wider than the toner supply port.

4. The development device according to claim 1, wherein a supply toner transporting length of the dispensing room is larger than the dispensing room entrance opening length.

5. The development device according to claim 1, wherein the transporting power of the supply toner by the dispensing member is set larger than the developer transporting power applied to the toner supply port by the developer agitating and transporting member.

6. The development device according to claim 1, wherein the supply amount of the supply toner to the dispensing room entrance opening by the toner transporting member of the toner supply room is set larger than the transporting amount of the supply toner by the dispensing member.

7. The development device according to claim 1, wherein:

the developer agitating and transporting member is formed of an auger; and the diameter of the dispensing member is the same as that of the developer agitating and transporting member or less.

8. The development device according to claim 1, wherein:

the developer agitating and transporting member is formed of an auger; and the pitch of the dispensing member is less than that of the developer agitating and transporting member.

9. The development device according to claim 1, wherein a vane member for weir is provided at the portion faced to the toner supply port, of the dispensing member.

10. The development device according to claim 1, wherein: a vane member along the axial direction is provided at the portion faced to the toner supply port of the dispensing member.

11. The development device according to claim 1, wherein: the vane pitch at the portion faced to the toner supply port of the dispensing member is narrower than the vane pitch at other portions.

12. The development device according to claim 1, wherein an eaves-shaped return part facing in the toner transporting direction is provided at a downstream side edge of the toner supply port in the transporting direction.

13. The development device according to claim 1, wherein the capacity of rooms that house the toner other than the dispensing room of the toner supply room is larger than the capacity of the dispensing room.

14. The development device according to claim 1, wherein the capacity of rooms that house the toner other than the dispensing room of the toner supply room is larger than the total capacity of the dispensing room and the developer housing room.

15. The development device according to claim 1, wherein the upper end of the toner supply port is located in a lower position than the upper end portion of the developer agitating and transporting member.

16. The development device according to claim 1, wherein:

a toner agitating and transporting member as a toner transporting member is provided in the toner supply room at a location other than the dispensing room of the toner supply room; and a rotation center of the toner agitating and transporting member is located in a position higher than the dispensing member.

17. A process cartridge detachably attached to an image forming apparatus body, comprising:

an image bearing member; and a development device including:

developer composed of toner and carrier;

a development unit which includes a developer housing room in which the developer composed of toner and carrier is housed, a developer agitating and transporting member in the developer housing room, and a developer bearing member which can bear and transport the developer agitated and transported by the developer agitating and transporting member;

supply toner; and a toner supply unit which includes a toner supply room in which at least the supply toner is housed, a toner transporting member in the toner supply room, and communicates the toner supply room with the developer housing room of the development unit through a toner supply port, wherein:

the toner supply port of the toner supply unit opens so that its lower end is located in a lower position than a surface position of the developer at a position contacting with the toner supply port and housed in the developer housing room; and the development device is arranged opposed to the image bearing member;

wherein press power by which the supply toner in the toner supply unit is pushed out from the toner supply port is larger than the internal pressure of the developer in the developer housing room, wherein the toner supply room includes a dispensing room which is formed at the portion faced to the toner supply port and can supply the supply toner quantitatively, a dispensing member for quantitative supply as a toner transporting member in the dispensing room, and includes a dispensing room entrance opening at a communication portion with the dispensing room, and wherein the dispensing member is an auger provided with an agitating and transporting vane and a vane for weir around a rotation shaft of the auger;

wherein the lower end of the toner supply port is located in a position lower than a rotation center of the developer agitating and transporting member;

wherein the toner supply port of the toner supply unit communicates the dispensing room of the toner supply unit with the developer housing room of the development unit;

wherein the toner supply port of the toner supply unit opens at a position which faces a boundary between the agitating and transporting vane provided in the dispensing member and the vane for weir provided in the dispensing member.

18. An image forming apparatus including:

an image forming apparatus body; and a process cartridge detachably attached to an image forming apparatus body, including:

an image bearing member; and a development device having: developer composed of toner and carrier; a development unit which includes a developer housing room in which the developer composed of toner and carrier is housed, a developer agitating and transporting member in the developer housing room, and a developer bearing member which can bear and transport the developer agitated and transported by the developer agitating and transporting member; supply toner; and a toner supply unit which includes a toner supply room in which at least the supply toner is housed, a toner transporting member in the toner supply room, and a toner supply port, wherein the toner supply room communicates with the developer housing room of the development unit through a toner supply port, wherein:

the toner supply port of the toner supply unit opens so that its lower end is located in a position lower than a surface position of the developer at a position contacting with the toner supply port and housed in the developer housing room; and the development device is arranged opposed to the image bearing member;

wherein press power by which the supply toner in the toner supply unit is pushed out from the toner supply port is larger than the internal pressure of the developer in the developer housing room, wherein the toner supply room includes a dispensing room which is formed at the portion faced to the toner supply port and can supply the supply toner quantitatively, sets a dispensing member for quantitative supply as a toner transporting member in the dispensing room, and includes a dispensing room entrance opening at a communication portion with the dispensing room, and wherein the dispensing member is an auger provided with an agitating and transporting vane and a vane for weir around a rotation shaft of the auger;

wherein the lower end of the toner supply port is located in a lower position than a rotation center of the developer agitating and transporting member;

wherein the toner supply port of the toner supply unit communicates the dispensing room of the toner supply unit with the developer housing room of the development unit;

wherein the toner supply port of the toner supply unit opens at a position which faces a boundary between the agitating and transporting vane provided in the dispensing member and the vane for weir provided in the dispensing member.

19. An image forming apparatus comprising:

an image bearing member, and a development device including:

developer composed of toner and carrier;

a development unit which includes a developer housing room in which the developer composed of toner and carrier is housed, a developer agitating and transporting member in the developer housing room, and a developer bearing member which can bear and transport the developer agitated and transported by the developer agitating and transporting member;

a supply toner; and a toner supply unit which includes a toner supply room in which at least the supply toner is housed, a toner transporting member in the toner supply room, and a toner supply port, wherein the toner supply room communicates with the developer housing room of the development unit through a toner supply port, wherein:

the toner supply port of the toner supply unit opens so that its lower end is located in a lower position than a surface position of the developer at a position contacting with the toner supply port and housed in the developer housing room; and the development device is arranged opposed to the image bearing member;

wherein press power by which the supply toner in the toner supply unit is pushed out from the toner supply port is larger than the internal pressure of the developer in the developer housing room, wherein the toner supply room includes a dispensing room which is formed at the portion faced to the toner supply port and can supply the supply toner quantitatively, a dispensing member for quantitative supply as a toner transporting member in the dispensing room, and includes a dispensing room entrance opening at a communication portion with the dispensing room, and wherein the dispensing member is an auger provided with an agitating and transporting vane and a vane for weir around a rotation shaft of the auger;

wherein the lower end of the toner supply port is located in a lower position than a rotation center of the developer agitating and transporting member;

wherein the toner supply port of the toner supply unit communicates the dispensing room of the toner supply unit with the developer housing room of the development unit;

wherein the toner supply port of the toner supply unit opens at a position which faces a boundary between the agitating and transporting vane provided in the dispensing member and the vane for weir provided in the dispensing member.

* * * * *